US008282198B2

(12) United States Patent
Asaki et al.

(10) Patent No.: US 8,282,198 B2
(45) Date of Patent: Oct. 9, 2012

(54) INK JET RECORDING APPARATUS

(75) Inventors: Noriyasu Asaki, Yokohama (JP); Yui Kitamura, Yokohama (JP); Yasushi Nakano, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 1169 days.

(21) Appl. No.: 12/128,301

(22) Filed: May 28, 2008

(65) Prior Publication Data

US 2008/0297575 A1 Dec. 4, 2008

(30) Foreign Application Priority Data

Jun. 4, 2007 (JP) ..... 2007-148501
Apr. 21, 2008 (JP) ..... 2008-110440

(51) Int. Cl.
*B41J 2/175* (2006.01)

(52) U.S. Cl. ..... 347/86; 347/36

(58) Field of Classification Search ..... 347/36, 347/86
See application file for complete search history.

(56) References Cited

U.S. PATENT DOCUMENTS

| | | | | |
|---|---|---|---|---|
| RE29,524 | E * | 1/1978 | Spencer | 428/134 |
| 5,517,221 | A * | 5/1996 | Nguyen | 347/31 |
| 6,280,513 | B1 | 8/2001 | Osumi et al. | |
| 2003/0142150 | A1 * | 7/2003 | Barton et al. | 347/2 |
| 2003/0184634 | A1 * | 10/2003 | Crosby et al. | 347/104 |
| 2004/0001119 | A1 * | 1/2004 | Johnson | 347/36 |
| 2005/0128241 | A1 * | 6/2005 | Kulpa | 347/22 |
| 2006/0017770 | A1 * | 1/2006 | Harada et al. | 347/36 |
| 2006/0238564 | A1 | 10/2006 | Ishihara | |
| 2007/0008372 | A1 * | 1/2007 | Katada | 347/36 |
| 2007/0109346 | A1 | 5/2007 | Nakazawa et al. | |

FOREIGN PATENT DOCUMENTS

| | | | |
|---|---|---|---|
| EP | 1619031 | A2 * | 1/2006 |
| JP | 61012352 | A * | 1/1986 |
| JP | 5-162334 | | 6/1993 |
| JP | 7-57547 | B2 | 6/1995 |
| JP | 7314729 | A | 12/1995 |
| JP | 10-296999 | | 11/1998 |
| JP | 11058780 | A * | 3/1999 |
| JP | 2000141705 | A * | 5/2000 |
| JP | 2000-198955 | | 7/2000 |
| JP | 2000-203059 | | 7/2000 |
| JP | 2004230845 | A * | 8/2004 |
| JP | 2005-119210 | | 5/2005 |
| JP | 2005-119210 | A | 5/2005 |
| JP | 2006-044243 | A | 2/2006 |
| JP | 2006-168352 | | 6/2006 |

(Continued)

OTHER PUBLICATIONS

Korean Intellectual Property Office, Notice of Allowance, May 24, 2011.

(Continued)

*Primary Examiner* — Charlie Peng
*Assistant Examiner* — Peter Radkowski
(74) *Attorney, Agent, or Firm* — Fitzpatrick, Cella, Harper & Scinto

(57) ABSTRACT

A residual ink container comprising laminated members for absorbing residual ink not used for recording, wherein the laminated members are laminated with a gap between adjacent ones of the members; and a covering member covering such that non-contact portion is provided between the covering member and a topmost one of the laminated member so as not to press against the topmost one.

9 Claims, 8 Drawing Sheets

FOREIGN PATENT DOCUMENTS

| | | | |
|---|---|---|---|
| JP | 2006-263937 | | 10/2006 |
| JP | 2006-272733 | | 10/2006 |
| JP | 2006-272734 | | 10/2006 |
| JP | 2006-272735 | | 10/2006 |
| JP | 2007-030235 | | 2/2007 |
| JP | 2007-148501 | A | 6/2007 |
| JP | 2008-110440 | A | 5/2008 |
| KR | 2006-0046709 | | 5/2006 |

OTHER PUBLICATIONS

Notification of First Office Action—Appl. No. 2008101086771, The State Intellectual Property Office of P.R. China, Jan. 8, 2010 (with English translation).

* cited by examiner

INK JET RECORDING APPARATUS

FIELD OF THE INVENTION AND RELATED ART

The present invention relates to an ink jet recording apparatus provided with a waste ink absorbing member in the form of a roughly parallelepipedic thin plate. It also relates to a waste ink storage unit which is significantly higher in ink absorbency and ink storage capacity, being therefore significantly longer in service life than a waste ink storage unit in accordance with the prior art.

An ink jet recording apparatus is a recording apparatus which forms an image on a sheet of recording medium, such as ordinary paper, glossy paper, and specifically coated paper, by ejecting small droplets of ink so that they land on the sheet of recording medium. In recent years, an ink jet recording apparatus has been significantly reduced in price, and it has also been significantly increased in printing speed. Thus, the usage of an ink jet recording apparatus has been quickly spreading into various fields. Further, an ink jet recording apparatus has also been improved in image quality, and usage of digital cameras has quickly spread. Thus, an ink jet recording apparatus has come to be widely used as an apparatus for outputting a photographic image which matches in quality to a silver-salt photographic image. In order to ensure that an ink jet recording apparatus remains normal in ink ejection performance, an ink jet recording apparatus is generally provided with a mechanism for forcefully discharge ink through the ink ejection nozzles of the ink jet head of the ink jet recording apparatus. It is also provided with a waste ink storage portion for storing waste ink, that is, the ink ejected to keep an ink jet recording apparatus normal in ink ejection performance. A waste ink storage portion has a waste ink absorbing member which absorbs and retains ink. That is, a waste ink storage portion has the function of absorbing waste ink by its absorbing member and retaining the waste ink in the absorbing member.

There are various inks usable with an ink jet recording apparatus. In recent years, various improvements have been made to the coloring agent suitable for image formation. Various improvements have also been made to the other ingredients of ink other than the coloring agents. For example, a substantial amount of effort has been made in the development of such ink that can prevent ink mixture (bleeding), in particular, the ink mixture which occurs along the border between the area covered with black ink and the area covered with color ink(s). Japanese Laid-open Patent Application 2000-198955 discloses an ink which contains self-diffusive carbon black and specific salt(s). According to this patent application, this ink is not liable to permeate recording medium, being therefore unlikely to cause "bleeding", even with the absence of liquid reactive to ink. An ink, such as the one disclosed in the abovementioned patent application, which contains an ingredient, or ingredients, which are advantageous from the standpoint of image formation, is liable to more quickly dry (solidify), being therefore liable to unpredictably solidify in an unexpected area or areas of a waste ink absorbing unit (member, or portion). Therefore, this type of ink sometimes makes it difficult to effectively use a waste ink absorbing unit (member, portion), because a waste ink absorbing unit (member, portion) is for properly recovering waste ink, and storing it while allowing it to dry in a proper manner. Japanese Laid-open Patent Application 2006-168352 discloses an ink absorbing member which contains an antiagglutinant for preventing coloring agent(s) in ink from agglutinating. This invention is effective to solve the problem that coloring agent(s) adheres to an ink absorbing member as it solidifies.

On the other hand, there have been proposed to simply change a waste ink storage member in structure, and/or the manner in which waste ink is disposed. For example, Japanese Laid-open Patent Application H05-162334 discloses an ink cartridge which contains an ink absorbing member made up of a long strip of absorbent fabric folded in layers. Japanese Laid-open Patent Application 2000-203059 discloses a waste ink absorbing portion made up of a waste ink absorbing member housing with a cover (lid), and a waste ink absorbing member disposed in the housing. In this case, the waste ink absorbing member is made up of multiple waste ink absorbing portions, which are separated by slits, are arranged side by side in parallel, or simply stacked in layers. Further, Japanese Laid-open Patent Application H10-296999 also discloses an ink cartridge provided with a waste ink absorbing member. This waste ink absorbing member is provided with multiple waste ink absorbing portions, the surfaces of which are implanted with strands of natural and/or resinous fibers to prevent the waste ink absorbing portion which catches the waste ink preparatorily ejected from an ink jet head, from becoming nappy. The ink absorbing portions of this waste ink absorbing member are airtightly stacked in layers. In the case of this waste ink absorbing member, that is, a waste ink absorbing member made up of multiple waste ink absorbing portions stacked airtightly in layers, ink is made to permeate in the direction in which the waste ink absorbing portions are stacked, and ink is stored in liquid state. Further, the entire surfaces of the waste ink absorbing member, except for the top surface, are airtightly in contact with the waste ink absorbing member housing.

Further, a waste ink storage for pigment-based ink, which is structured so that pigment-based ink is dripped onto a single waste ink absorbing member from a tube for guiding into the waste ink absorbing member, suffers from the following problem. That is, while pigment-based waste ink is guided into a waste ink absorbing member, it dries. Therefore, in a case where a waste ink absorbing member for absorbing pigment-based waste ink is made up of a single ink absorbing portion, the waste ink absorbing member is prevented from displaying its full potential in terms of waste ink absorbency. In recent years, therefore, various proposals have been made to solve this problem by impregnating the ink absorbing portion of a waste ink absorbing member having only a single absorbing portion, with some additive or other to retain waste ink in liquid state, while expecting that a certain amount of waste ink will evaporate. For example, Japanese Laid-open Patent Application 2006-263937 discloses a waste ink absorbing member which is impregnated with a liquid which contains evaporation-retardant and bases. Japanese Laid-open Patent Application 2006-272733 discloses a waste ink absorbing member impregnated with a permeation promoter liquid which contains water-soluble resin. Japanese Laid-open Patent Application 2006-272734 discloses a waste ink absorbing member impregnated with a permeation promoter liquid which contains a resin which does not easily dissolve in water. Japanese Laid-open Patent Application 2006-272735 discloses a waste ink absorbing member impregnated with a permeation promoter liquid which contains diol and silicon surfactant glycerin. Japanese Laid-open Patent Application 2007-30235 discloses a waste ink absorbing member impregnated with a permeation promoter liquid which contains an antifoaming agent. Incidentally, all of these documents are similar in that the surface of the waste ink absorbing member is partially covered with a layer of saturated polyester film to prevent the absorbed waste ink from drying with the permeation promoter liquid.

The inventors of the present invention studied the technical concepts disclosed in the above described prior arts, by actually testing a waste ink absorbing member which was made up of multiple roughly rectangular parallelepipedic waste ink absorbing portions stacked simply in layers. For example, in the case of an experiment in which the waste ink absorbing member was impregnated with some high polymer or other to promote waste ink to efficiently diffuse in the waste ink absorbing member, waste ink tended to concentrate in a certain area of the ink absorbing member, instead of diffusing throughout the waste ink absorbing member. That is, even when the amount of waste ink was very small, the waste ink quickly rose to a part or parts of the top portion of the waste ink absorbing member. Once the waste ink rose to a part or parts of the surface of the ink absorbing member, the non-evaporative components in the waste ink delivered thereafter accumulated on the surface of the waste ink absorbing member as if stalactite were accumulating thereon. This phenomenon was particularly conspicuous when the waste ink contained a coloring agent which was highly agglutinative on a sheet of paper. Thus, in order to retard the evaporation, a piece of film formed of the saturated polyester stated in one of the abovementioned documents was bonded to the waste ink absorbing member structured as described above. However, as the body of the non-evaporative components in the waste ink grew like a body of stalactite, it pushed up this film far enough for the film to come into contact with the ink jet head (abnormal condition). Further, in recent years, in order to improve an ink jet recording apparatus in terms of the amount by which ink is actually used for image formation, the amount by which ink is to be preparatorily ejected was significantly reduced, and therefore, this phenomenon has become even more conspicuous for the following reason. That is, as the amount by which ink is preliminarily ejected was reduced, the ratio by which water evaporates from waste ink increased, which was confirmed. This phenomenon was particularly conspicuous in the case where the waste ink absorbing member (portion) was made up of a single waste ink absorbing portion which is in the form of a roughly rectangular parallelepipedic piece of plate, or multiple roughly rectangular parallelepipedic ink absorbing portions stacked airtightly in layers. As will be evident from the above given description of the problems with which the waste ink absorbing member (portions) in accordance with the prior art suffer, the inventors of the present invention reached a conclusion that the conventional ideas cannot solve any of the above described problems.

SUMMARY OF THE INVENTION

The problems which the present invention is intended to solve are those discovered for the first time through the above described studies made, by the inventors of the present invention, regarding conventional waste ink absorbing units, members, portions, etc., that is, waste ink absorbing units, members, portions, etc., which are in accordance with the prior art. Thus, the primary object of the present invention is to solve at least one of the problems which conventional ink absorbing units, members, portions, etc., suffer.

The first object of the present invention is to provide an innovative waste ink absorbing unit capable of enabling its ink absorbing member (made up of single or multiple ink absorbing portions) to fully display its natural function as an absorbent member, regardless of waste ink type, by analyzing how waste ink behaves as it is delivered to the ink absorbing portion of a waste ink absorbing unit.

The second object of the present invention is to provide a printer equipped with an innovative waste unit, which is not only significantly smaller in the amount of space it requires, but also, capable of continuously absorbing waste ink for a significantly longer period of time, and therefore, makes the printer more reliable than a printer equipped with a conventional ink absorbing unit.

The third object of the present invention is to provide an innovative waste ink absorbing unit, which is not affected in performance by the properties of its waste ink absorbing portion(s), remains effective even when waste ink is small in water content, and remains at a satisfactory level in performance for a preset length of time.

According to an aspect of the present invention, there is provided a residual ink container comprising laminated members for absorbing residual ink not used for recording, wherein said laminated members are laminated with a gap between adjacent ones of the members; and a covering member covering such that non-contact portion is provided between said covering member and a topmost one of said laminated member so as not to press against said topmost one.

According to another aspect of the present invention, there is provided an ink jet recording apparatus comprising such a residual ink container.

According to a further aspect of the present invention, there is provided an ink jet recording apparatus comprising a residual ink accommodation unit having elongated-plate-like laminated members for accommodating residual ink not used for recording, wherein at least a topmost one of said laminated members has a surface portion which does not contain organic solvent and which is exposed to ambient air, and an evaporation suppression member disposed above said topmost one with a gap between itself and the topmost one, wherein said evaporation suppression member extends bridging between a first ink receiving portion and a second ink receiving portion.

According to the present invention, a waste ink absorbing unit is made up of a waste ink absorbing member housing, a waste ink absorbing member made up of multiple waste ink absorbing portions, and a cover which functions as an evaporation retarding member. Therefore, even if it is used with a set of inks which has been improved to minimize "bleeding," and also, from the standpoint of image preservation, the evaporation of the resultant waste ink is retarded by the cover. Therefore, the non-evaporative components in the waste ink are prevented from agglutinating on the surface of the waste ink absorbing portion, and/or inside the waste absorbing portion.

Also according to the present invention, the waste ink absorbing portions of a waste ink absorbing unit are simply stacked in layers so that minute spaces remain between the adjacent two waste ink absorbing portions. Therefore, proper balance is maintained between the amount by which the evaporative components in waste ink evaporate, and the amount by which waste ink diffuses in the waste ink absorbing portion(s), making it possible for waste ink to be absorbed throughout the waste ink absorbing portion(s), while preventing the waste ink absorbing portion(s) from reducing in waste ink absorbency. In other words, the present invention made it possible for a waste ink absorbing portion to fully display its natural function, making it possible for a waste ink absorbing unit to full displays its function, regardless of waste ink type.

Also according to the present invention, a waste ink absorbing portion is not impregnated with agglutination retarding liquid (which is generic term for glycerin or the like organic solvents). Therefore, it does not occur that waste ink quickly reduces in water content. Therefore, the present invention can solve the newly discovered problem that the quick reduction in the water content of waste ink, which is caused by the presence of agglutination retarding liquid in a waste ink absorbing portion, causes the non-evaporative components in waste ink to accumulatively deposit. Thus, the present invention is applicable to various ink jet recording apparatuses different in usage and the environment in which they are used. Further, it can prevent the problem that the interior of a recording apparatus, or a copy is soiled on its reverse side. In conclusion, the present invention can reduce in size a waste ink absorbing unit (member, portion), and also, improve an ink jet recording apparatus in reliability and length of service life.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 5 illustrates the waste ink storage unit, wherein (*a*) is a sectional view of the entirety of the waste ink storage unit shown in FIG. 2, and (*b*) is an enlarged schematic sectional view of a part of the waste ink storage unit shown in FIG. 2, showing the direction in which waste ink permeates through the ink absorbing member.

DETAILED DESCRIPTION OF THE PREFERRED EMBODIMENTS

Figure 1:
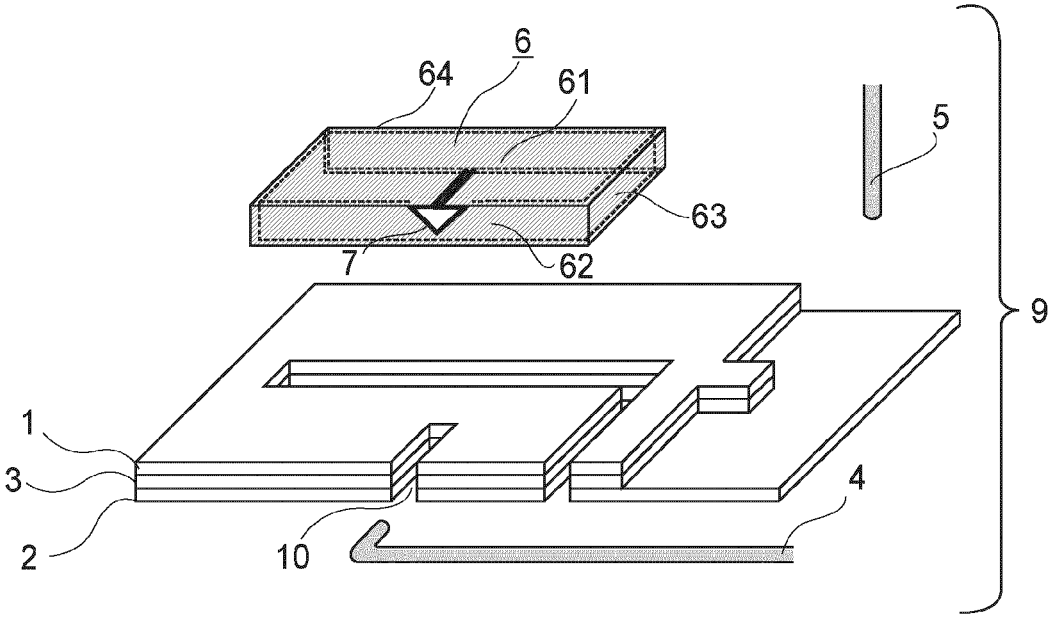
FIG. 1 is an exploded perspective view of the waste ink storage unit in the first embodiment of the present invention.

As an ink jet recording apparatus is reduced in size, a waste ink absorption unit therefor has been reduced in size (rendered compact), and also, modified in shape and placement, so that it can be disposed in a compact ink jet recording apparatus, without reducing it in waste ink absorbency, and sacrificing the internal space designated for recording function of the apparatus. As described above, the inks for an ink jet are required to be versatile in usage. In other words, they must be varied in ingredient according to they usage. For example, in a case where an ink, one of the ingredients of which is an ingredient, such as pigment, which is rather large in molecular weight, and/or an ingredient which is liable to agglutinate, is manufactured, a complicated formulating process is frequently used. Therefore, it has become necessary for a waste ink absorbing unit (which sometimes may be referred to as waste ink storage portion) to be effective regardless of waste ink type.

However, an ink which is complex in composition is also complex in its behavior in a waste ink absorbing member. Therefore, how an ink which is complex in composition behaves in a waste ink storage unit cannot be predicted based on the behavior of an ink, the coloring agent of which is a dye, which is simpler in composition than pigment. An ink which tends to agglutinate as its solvent evaporates, or it is subjected to the like change, sometimes fails to permeate into a waste ink absorbing member as expected, even if the waste ink absorbing member has been impregnated with an organic solvent which is capable of functioning as the solvent for the ink.

The inventors of the present invention studied the effect of using a roughly rectangular parallelepipedic piece of ink absorbing substance as a waste ink absorbing member, in order to increase the waste ink absorbing member in the size of its area which is exposed to (is in contact with) the air. That is, they hypothesized that increasing the waste ink absorbing member in the size of its area, which is in contact with the air, promotes the evaporation of the solvent portion of the waste ink, and therefore, it makes it possible to cause the waste ink delivered from the waste ink delivery portion to permeate throughout the waste ink absorbing member. However, when the surface of the waste ink absorbing member was kept exposed to the air, the waste ink absorbing member sometimes failed to be efficiently used. Thus, the inventors of the present invention paid attention to the fact that the dynamics regarding the movement of the air in a waste ink absorbing member, and the changes which occur to waste ink while it is delivered to the waste ink absorbing member, and also, while it moves through the waste ink absorbing member, could be listed as essential issues for solving the above described problems. As a result, the inventors discovered that properly controlling the evaporation of the solvent portion of the waste ink in the top portion of a waste ink absorbing member enables the waste ink to efficiently move in the waste ink absorbing member, making it possible for the waste ink to be stored throughout the waste ink absorbing member, and also, that the evaporation of the solvent portion of the waste ink in the top portion of the waste ink absorbing member can be properly controlled by properly controlling the movement of the air in the top portion of the waste ink absorbing member. More concretely, it may be reasonable to think that the speed with which waste ink permeates (moves through) a roughly rectangular parallelepipedic waste ink absorbing member in the lengthwise direction of the waste ink absorbing member can be increased relative to the speed with which the waste ink permeates (moves through) the ink absorbing member in the thickness direction of the ink absorbing member, by controlling the abovementioned movement of the air, and evaporation of the solvent portion of the waste ink. Therefore, it is also reasonable to think that the entirety of the roughly rectangular parallelepipedic waste ink absorbing member can be effectively used by moving waste ink in the waste ink absorbing member faster in the lengthwise direction of the ink absorbing member than in the thickness direction of the ink absorbing member. According to the present invention, as one of the means for making waste ink move in a roughly rectangular parallelepipedic waste ink absorbing member, faster in the lengthwise direction of the ink absorbing member than in the thickness direction of the ink absorbing member, an ink absorbing unit is provided with a cover, which is placed above the ink absorbing member of the ink absorbing unit, in such a manner that there is no contact between the cover and a part of the top ink absorbing portion of the ink absorbing member, that is, in such a manner that a part of the top ink absorbing portion of the ink absorbing member is not compressed by the cover. Further, the ink absorbing unit is provided with a cover (evaporation retarding member) for retarding the evaporation of the evaporative components in the waste ink absorbing member, which is positioned above the top surface of the waste ink absorbing member with the presence of a space between the cover and waste ink absorbing member. As for another means for making waste ink move in an ink absorbing member faster in the lengthwise direction of the waste ink absorbing member than in the thickness direction of the waste ink absorbing member, a waste ink absorbing unit is provided with a cover (evaporation retarding member) structured so that as it is properly positioned, it partially covers both of the two waste ink receiving portions of the top surface of a waste ink absorbing member, in order to retard the evaporation of the evaporative components in the waste ink absorbing member. This cover is placed above the waste ink absorbing member with the presence of a space between the cover and the top surface of the ink absorbing member. In other words, an ink absorbing unit in accordance with the present invention is extremely simply in structure. "Retarding the evaporation by a cover" means slowing the evaporation by an amount necessary to make waste ink move in a waste ink absorbing member faster in the lengthwise direction of the waste ink absorbing member than in the thickness direction of the waste ink absorbing member. It does not mean to completely stop the evaporation. Thus, the above described cover may be referred to as an evaporation retarding member to describe the function of the cover.

Regarding the structure of the waste ink storage portion assembled as a part of an ink jet recording apparatus, an ink absorbing unit is provided with a cover, which is placed above the ink absorbing member of the ink absorbing unit, in such a manner that there is no contact between the cover and a part of the top ink absorbing portion of the ink absorbing member, that is, in such a manner that the multiple waste ink absorbing portions of the waste ink absorbing member are not subjected to compressive force. Further, the waste ink storage portion is for storing the waste ink, that is, the ink which was not used for recording. It has a waste ink storage unit, which has a waste ink absorbing member made up of multiple roughly rectangular parallelepipedic waste ink absorbing portions stacked in layers, and which is placed in the main assembly of an ink jet recording apparatus. Further, at least the top waste ink absorbing portion among the multiple waste ink absorbing portions of which the waste ink absorbing member is made up, does not contain organic solvent, and is in contact with the air by one of its surfaces. Moreover, this waste ink absorbing unit has first and second ink receiving portions, which guide waste ink into the waste ink absorbing member (waste ink absorbing portions). Further, the waste ink absorbing unit is provided with an evaporation retarding member, which is placed above the top waste ink absorbing portion, in a manner to partially cover both of the two ink receiving portions, with the presence of a space between the cover and the top waste ink absorbing portion.

The waste ink absorbing member is made up of multiple waste ink absorbing members which are simply stacked in layers. Here, "simply stacked in layers" means to stack multiple waste ink absorbing portions in layers without bonding or welding the adjacent two waste ink absorbing portions to each other. Thus, in the case of a waste ink absorbing member in accordance with the present invention, there are minute spaces between the adjacent two waste ink absorbing portions. It is desired that these minute spaces can come into contact, as necessary, with the external air of the waste ink absorbing unit. This structural arrangement which provides minute spaces between the adjacent two of the multiple waste ink absorbing portions stacked in layers contributes to the retarding of the upward movement of waste ink in the waste ink absorbing member, which is promoted by the evaporation. It should be noted here that the present invention encompasses a structural arrangement for a waste ink absorbing member, which provides minute spaces between the adjacent two of the multiple waste ink absorbing portions by placing multiple nonabsorbent spacers between the adjacent two waste ink absorbing portions, with the provision of a preset amount of interval between the adjacent two of the multiple spacers.

The waste ink storage unit has a couple of ink receiving portions, which appears as if they were created by carving away certain portions of the waste ink absorbing member. From the standpoint of practicality, it is desired that the evaporation retarding member has a hole which allows the first ink receiving portion to receive waste ink.

Regarding various portions of the waste ink absorbing member in terms of volume, it is desired that the portion of the second waste ink absorbing portion of the waste ink absorbing member, which is covered with the evaporation retarding member, is smaller in volume than the portion of the first waste ink absorbing portion of the waste ink absorbing member, which is also covered with the evaporation retarding member.

Hereinafter, the preferred embodiments of the present invention will be described in detail.

The present invention is for making waste ink desirably diffuse in a waste ink absorbing member before the agglutinative components in the waste ink begin to agglutinate, to prevent the waste ink from concentrating in a part or parts of the waste ink absorbing member, in order to prevent the problem that the non-evaporative components in waste ink cumulatively deposit on the surface of, and within, a waste ink absorbing member.

Hereafter, the preferred embodiments of the present invention will be described with reference to the appended drawings.

<Waste Ink Storage Unit>

FIG. 1 is an exploded perspective view of the waste ink storage unit 9 of the ink jet recording apparatus in the first embodiment of the present invention. The waste ink storage unit 9 is made up of a waste ink absorbing member, which is in the form of a roughly rectangular parallelepipedic piece of plate. FIG. 1 shows the first example of the structural design for a waste ink storage unit in accordance with the present invention. The waste ink storage unit in this embodiment is a part of the unshown ink jet recording apparatus. It stores the ink discharged through the ink jetting nozzles of the ink jet head to keep the ink jet head normal in performance.

The waste ink storage unit 9 has a waste ink absorbing member which stores the discharged ink. The waste ink absorbing member is in the form of a roughly rectangular parallelepipedic piece of plate. It is made up of three rectangular parallelepipedic waste ink absorbing portions, that is, a top portion 1, a bottom portion 2, and a middle portion 3. Each portion is shaped so that the ratio of its lengthwise dimension (dimension in terms of left-to-right direction in FIG. 1) relative to its widthwise dimension (dimension in terms of direction perpendicular to lengthwise direction) is substantial. Its thickness is optional; it may be adjusted according to the ink jet recording apparatus with which it is used, desired level of waste ink absorbency, and the like factors. If it is intended for the usage with a compact ink jet recording apparatus, it is desired to be in a range of 3 mm-15 mm, preferably, 5 mm-12 mm. Further, each waste ink absorbing portion is structured so that its lengthwise dimension is roughly 5-20 times its thickness, and its widthwise dimension is 3-10 times its thickness. As the material for each of the roughly rectangular parallelepipedic waste ink absorbing portions (which hereafter will be referred to simply as parallelepipedic waste ink absorbing portion), a substance which has not been impregnated with organic solvent is used.

The three parallelepipedic waste ink absorbing members 1, 2, and 3 are not bonded to each other, or kept pressed against each other. Therefore, they are not airtightly in contact with each other. In other words, they are simply stacked in layers. In this embodiment, each of the three parallelepipedic waste ink absorbing portions is formed of a porous substance capable of absorbing waste ink. Its surface is not smooth; it is rough. Therefore, there are minute spaces between the first and third waste ink absorbing portions 1 and 3, and between the second and third waste ink absorbing portions 2 and 3.

Incidentally, the number of the parallelepipedic waste ink absorbing portions which are to be simply stacked in layers does not need to be limited to three. That is, all that is necessary is that the number is two or more.

The waste ink storage unit 9 is provided with a waste ink tube 4 and a waste ink tube 5, which are structured to deliver the ink discharged from the ink ejection nozzles of the ink jet head, to the parallelepipedic ink absorbing member. In this embodiment, the ink discharged through the waste ink tube 4 is a pigment-based ink which is made up of coloring pigment and "weak" solvent, that is, such an ink, the non-evaporative components of which are liable to agglutinate, whereas the ink to be discharged through the waste ink tube 5 is a dye-based ink, the non-evaporative components of which become highly agglutinative as the dye-based ink mixes with pigment-based ink. As long as the combination of pigment-based ink and dye-based ink is such that mixing of the dye-based ink into the pigment-based ink does not make the non-evaporative components in the pigment-based ink more liable to agglutinate, both the pigment-based ink and dye-based ink may be discharged together through the waste ink tube 4.

The waste ink storage unit 9 is provided with a cover (which hereafter may be referred to as evaporation retarding member), which is positioned in a manner to cover the slot 10 (hole) of the parallelepipedic waste ink absorbing member, and partially cover the three parallelepipedic waste ink absorbing portions 1, 2, and 3 of the parallelepipedic waste ink absorbing member. The evaporation retarding member 6 has four walls, that is, a top wall 61 and three lateral walls 62, 63, and 64. It also has a slot 7 for accommodating the waste ink tube 4.

Incidentally, the evaporation retarding member 6 does not need to have the lateral wall 64; it may be made up of only three walls. The evaporation retarding member 6 is positioned so that a certain portion or portions of the evaporation retarding member 6 are not in contact with the waste ink absorbing member, and also, so that it does not cause the three waste ink absorbing portions of the waste ink absorbing member to be compressed by each other.

Figure 2:
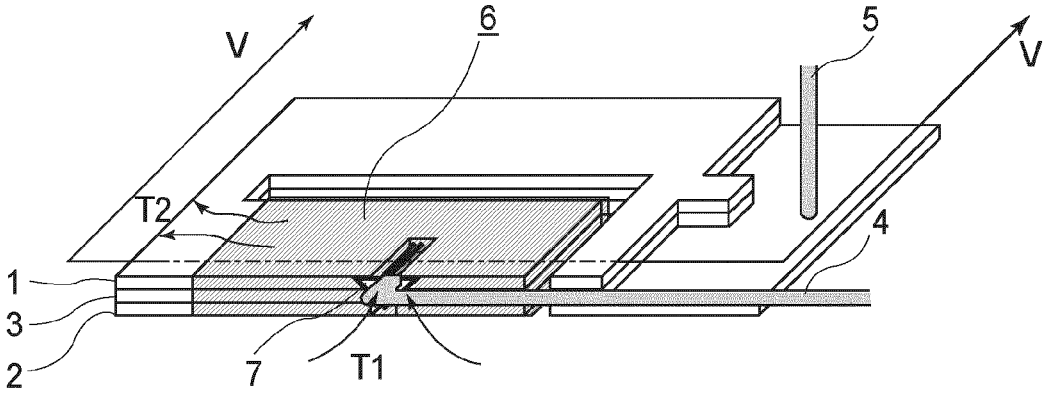
FIG. 2 is a perspective view of the assembled waste ink storage unit shown in FIG. 1.

FIG. 2 is a perspective view of the waste ink storage unit 9 made up of the parallelepipedic waste ink absorbing members 1, 2, and 3, waste ink tubes 4 and 5, and evaporation retarding member 6. The waste ink tube 4 is put through the slot 7 of the evaporation retarding member 6 so that its waste ink discharging end is in the slot 10 (FIG. 1) of the waste ink absorbing member. Dye-based ink is discharged onto the second parallelepipedic waste ink absorbing portion 2 from the waste ink tube 5, whereas pigment-based ink is discharged into the slot 10 (FIG. 1) of the second parallelepipedic waste ink absorbing portion 2 through the waste ink tube 4. After pigment-based ink is discharged into the slot 10, it is absorbed into the waste ink absorbing member through the portion of the vertical wall of the slot 10 (FIG. 1), which corresponds to the second parallelepipedic waste ink absorbing portion 2, and its adjacencies.

The evaporation retarding member 6 covers the slot 10 (FIG. 1), and also, partially covers the parallelepipedic waste ink absorbing portions 1, 2, and 3. It is in contact with the bottom wall of the waste ink absorbing member housing (unshown) of the waste ink storage unit 9.

In terms of the lengthwise direction of the parallelepipedic waste ink absorbing member, the cross section of the slot 7 is made larger than the cross section of the waste ink tube 4. Therefore, the slot 10 (FIG. 1) is practically in contact with the outside air through the slot 7. Further, there are minute spaces between the first parallelepipedic waste ink absorbing portion 1 and evaporation retarding member 6. Therefore, the first parallelepipedic waste ink absorbing portion 1 is practically exposed to the outside air through the slot 7. Therefore, it is possible for the air to flow in the direction indicated by arrow marks T1 and T2 through the abovementioned minute spaces and slot 7, or the opposite direction (unshown) from the direction indicated by the arrow marks T1 and T2. This evaporation retarding member 6 is for preventing the pigment-based ink from immediately evaporating after the discharging of the pigment-based ink through the waste ink tube 4. Since the slot 10 (FIG. 1) is in contact with the outside air only through the abovementioned minute spaces, the discharged pigment-based ink slowly evaporates.

In practical terms, the evaporation retarding member 6 prevents the evaporative components in the waste ink in the parallelepipedic waste ink absorbing portion 1, from evaporating out of the waste ink absorbing portion 1. It is formed of a substance suitable for such a function (purpose). Which portion of the top surface of the first parallelepipedic waste ink absorbing portion 1 is to be covered with the evaporation retarding member 6 is optional. That is, the evaporation retarding member 6 should be sized, shaped, and positioned so that it covers at least the portions of the top surface of the first parallelepipedic waste ink absorbing portion 1, which are immediately adjacent to the slot 10. However, it may be sized, shaped, and positioned so that it can cover roughly the entirety of the portion of the waste ink absorbing member, which is for storing the pigment-based waste ink, as shown in FIG. 2.

Further, the waste ink storage unit 9 may be structured as will be described next.

Figure 3:
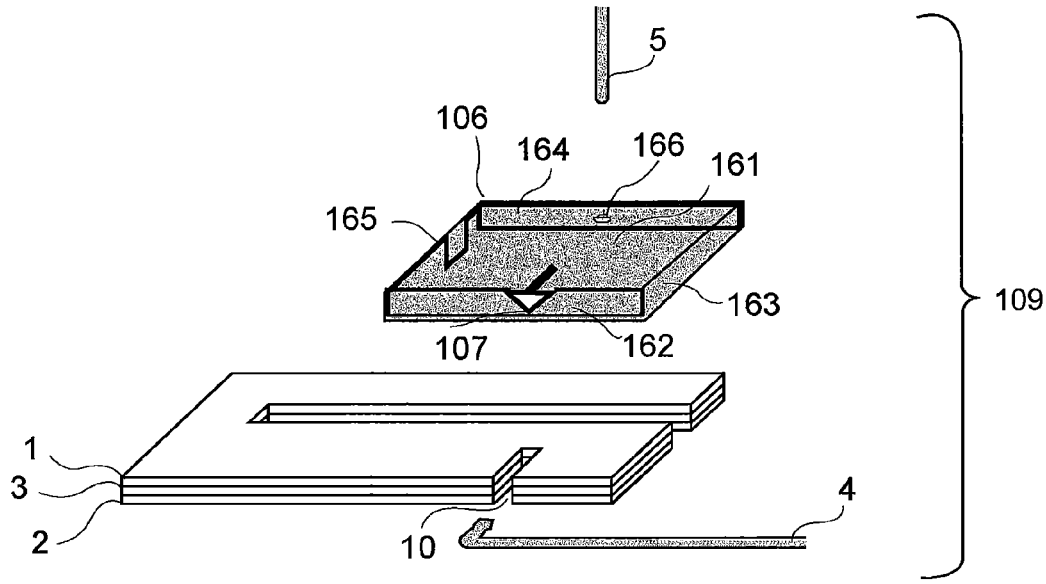
FIG. 3 is an exploded perspective view of the waste ink storage unit in the second embodiment of the present invention.

FIG. 3 is an exploded perspective view of the waste ink storage unit 109 (waste ink storage portion) of the ink jet recording apparatus in the second embodiment of the present invention. This waste ink storage unit 109 is also made up of roughly rectangular parallelepipedic waste ink absorbing members made up of multiple parallelepipedic waste ink absorbing portions. The waste ink storage unit in this embodiment is also a part of the unshown ink jet recording apparatus. It stores the ink forcefully discharged through the ink jetting nozzles of the ink jet head to keep the ink jet head normal in performance.

The waste ink storage unit 109 has a parallelepipedic waste ink absorbing member which stores the forcefully discharged ink. The parallelepipedic waste ink absorbing member is made up of three parallelepipedic waste ink absorbing portions 1, 2, and 3, which make up the top, bottom, and middle layers, respectively, of the parallelepipedic waste ink absorbing member. Each parallelepipedic waste ink absorbing portion is shaped so that the ratio of its lengthwise dimension (dimension in terms of left-to-right direction in FIG. 3) relative to its widthwise dimension (dimension in terms of direction perpendicular to lengthwise direction) is substantial. Its thickness is optional; it may be adjusted according to the ink jet recording apparatus with which it is used, desired level of waste ink absorbency, and the like factors. It can be intended for the usage with a compact ink jet recording to be in a range of 3 mm-15 mm, preferably, 5 mm-12 mm. Further, each portion is structured so that so that its lengthwise dimension is roughly 5-20 times its thickness, and its widthwise dimension is 3-10 times its thickness. As the material for each of the parallelepipedic waste ink absorbing members, a substance which has not been impregnated with organic solvent is used.

The three parallelepipedic waste ink absorbing portions 1, 2, and 3 are not bonded to each other, or kept pressed against each other. Therefore, they are not airtightly in contact with each other. In other words, they are simply stacked in layers. In this embodiment, each of the three parallelepipedic waste ink absorbing portions is formed of a porous substance capable of absorbing waste ink. Its surface is not smooth; it is rough. Therefore, there are minute spaces between the first and third waste ink absorbing portions 1 and 3, and between the second and third waste ink absorbing portions 2 and 3.

Incidentally, the number of the parallelepipedic waste ink absorbing portions which are to be simply stacked in layers does not need to be limited to three. That is, all that is necessary is that the number is two or more.

The waste ink storage unit 109 is provided with a waste ink tube 4 and a waste ink tube 5, which are structured to deliver the ink discharged forcefully from the ink ejection nozzles of the ink jet head to the parallelepipedic ink absorbing member. In this embodiment, it is a pigment-based ink which is made up of coloring pigment and "weak" solvent, that is, an ink the non-evaporative components of which are liable to agglutinate, that is discharged through the waste ink tube 4, whereas it is a dye-based ink, the non-evaporative components of which become highly agglutinative as the dye-based ink mixes with pigment-based ink, that is discharged through the waste ink tube 5.

The waste ink storage unit 109 is provided with an evaporation prevention member 106 (which hereafter may be referred to simply as cover), which is positioned in a manner to cover the slot 10 (hole) of the parallelepipedic waste ink absorbing member, and partially cover each of the three parallelepipedic waste ink absorbing portions 1, 2, and 3 of the parallelepipedic waste ink absorbing member. The evaporation retarding member 106 has five walls, that is, a top wall 161 and four lateral walls 162, 163, 164 and 165. It also has a slot 107 (ink receiving first portion) for accommodating the waste ink tube 4, and a slot 166 through which the waste ink tube 5 is put.

Figure 4:
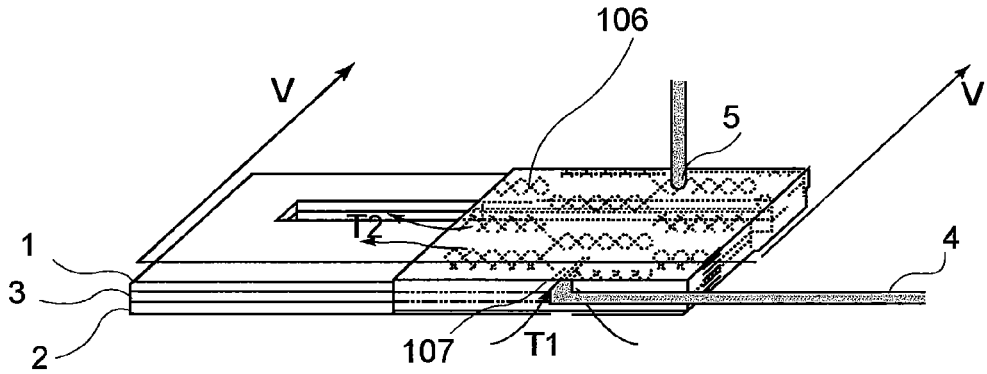
FIG. 4 is a perspective view of the assembled waste ink storage unit shown in FIG. 3.

FIG. 4 is a perspective view of the waste ink storage unit 109 made up of the parallelepipedic waste ink absorbing portions 1, 2, and 3, waste ink tubes 4 and 5, and evaporation retarding member 106. The waste ink tube 4 is put through the slot 107 (ink receiving first portion) of the evaporation retarding member 106 so that its waste ink discharging end is in the slot 10 (FIG. 3) of the waste ink absorbing member. The waste ink tube 5 is put through the slot 166 of the evaporation retarding member 106 so that its waste ink discharging end is on the first parallelepipedic waste ink absorbing portion 1. Dye-based ink is discharged onto the first parallelepipedic waste ink absorbing portion 1 from the waste ink tube 5, whereas pigment-based ink is discharged into the slot 10 (FIG. 3) of the second parallelepipedic waste ink absorbing portion 2. After pigment-based ink is discharged into the slot 10, it is absorbed into the waste ink absorbing member through the portion of the vertical wall of the slot 10 (FIG. 3), which corresponds to the second parallelepipedic waste ink absorbing portion 2, and its adjacencies.

The evaporation retarding member 106 covers the slot 10 (FIG. 3), and also, partially covers the parallelepipedic waste ink absorbing portions 1, 2, and 3 in a manner to cover the portion of the first parallelepipedic waste ink absorbing portion 1, onto which the dye-based ink is discharged through the waste ink tube 5. It is in contact with the bottom wall of the waste ink absorbing member housing (unshown) of the waste ink storage unit 109.

In terms of the lengthwise direction of the parallelepipedic waste ink absorbing member, the cross-section of the slot 107 is made larger than the cross-section of the waste ink tube 4. Therefore, the slot 10 (FIG. 3) is practically in contact with the outside air through the slot 107. Further, there are minute spaces between the first parallelepipedic waste ink absorbing portion 1 and evaporation retarding member 106. Therefore, the first parallelepipedic waste ink absorbing portion 1 is practically exposed to the outside air through the slot 107. Therefore, it is possible for the air to flow in the direction indicated by arrow marks T1 and T2 through the abovementioned minute spaces and slot 107, or the opposite direction (unshown) from the direction indicated by the arrow marks T1 and T2. This evaporation retarding member 106 is for preventing the pigment-based ink from immediately evaporating after the discharging of the pigment-based ink through the waste ink tube 4. Since the slot 10 (FIG. 3) is in contact with the outside air only through the abovementioned minute spaces, the discharged pigment-based ink slowly evaporates.

The slot 10, and the first parallelepipedic waste ink absorbing portion 1, onto which dye-based ink is discharged through the waste ink tube 5, are in connection with each other only through the abovementioned minute spaces. Therefore, the evaporative components of dye-based ink slow the evaporation of pigment-based ink, in the space in the evaporation prevention member 106.

In practical terms, the evaporation retarding member 106 prevents the evaporative components in waste ink from evaporating out of the first parallelepipedic waste ink absorbing portion 1. It is formed of a substance suitable for such a function (purpose). Which portion of the top surface of the first parallelepipedic waste ink absorbing portion 1 is to be covered with the evaporation retarding member 106 is optional. That is, the evaporation retarding member 106 should be sized, shaped, and positioned so that it covers at least the portions of the top surface of the first parallelepipedic waste ink absorbing portion 1, which are immediately adjacent to the slot 10. However, it may be sized, shaped, and positioned so that it can cover roughly the entirety of the portion of the waste ink absorbing member, which is for storing the pigment-based waste ink. Further, it may be sized, shaped, and positioned so that it covers at least the adjacencies of the waste ink discharging end of the waste ink tube 5, or so that it covers the waste ink absorbing member in a manner to cover both the pigment-based ink storing portion and dye-based ink storing portion of the waste ink absorbing member, while only partially covering the pigment-based ink storing portion.

<Diffusion of Pigment-Based Ink>

Figure 5:
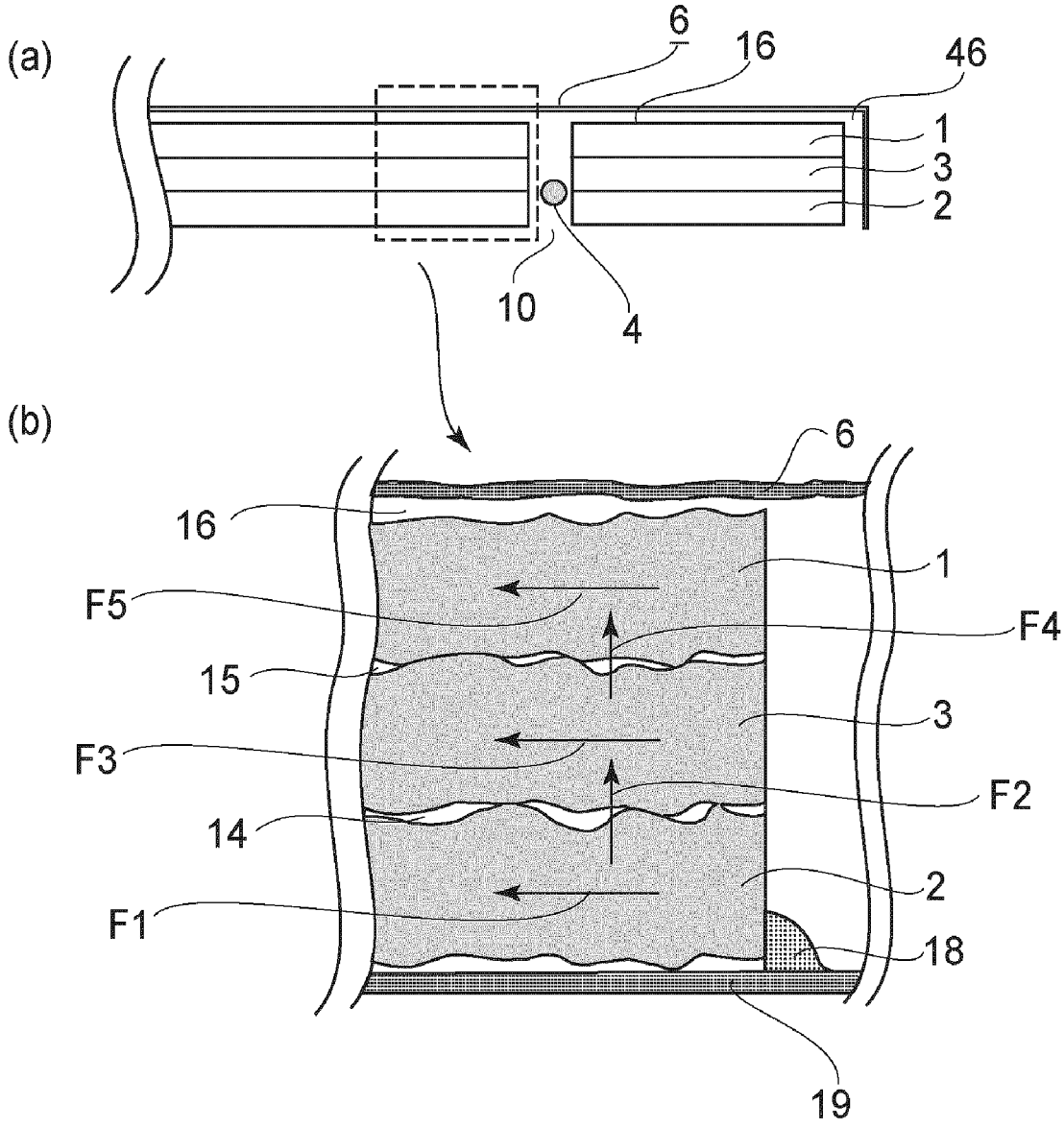
FIG. 5(*a*) is a sectional view of the entirety of the waste ink storage unit shown in FIG. 2.

FIG. 5 is a schematic sectional view of the waste ink storage unit in accordance with the present invention, at Line V-V in FIG. 2, and is for describing how, where, and in what manner the pigment-based ink diffuses in the parallelepipedic waste ink absorbing member after it is discharged into the slot 10 of the parallelepipedic waste ink absorbing member. Incidentally, what will be described next exactly applies to the structure of the waste ink storage unit, which is shown in FIGS. 3 and 4. However, for convenience, the same referential symbols as those used in FIGS. 1 and 2 will be used for FIG. 5 as well. In FIG. 5, (*a*) is a schematic sectional view of the portion of the waste ink absorbing member, into the slot 10 of which pigment-based ink is discharged from the waste ink tube 4, and its adjacencies. The waste ink absorbing member is structured so that ink is discharged into the slot 10 of the second parallelepipedic waste ink absorbing portion 2. As the pigment-based ink is discharged into the slot 10, it is absorbed into the second parallelepipedic waste ink absorbing portion 2 through the walls of the slot 10, and their adjacencies, and is stored in the waste ink absorbing member.

There are minute spaces between the evaporation prevention member 6 and first parallelepipedic waste ink absorbing portion 1. Thus, the slot 10 is practically in connection to the outside air through the minute spaces 16 and 46.

In FIG. 5, (*b*) is an enlarged schematic sectional view of the portion in (*a*), which is outlined by a broken line. The parallelepipedic waste ink absorbing portion 2 is simply placed on the bottom wall of the waste ink absorbing member housing 19 of the waste ink storage portion. The parallelepipedic waste ink absorbing portions 1 and 3 are simply stacked in layers on the second parallelepipedic waste ink absorbing portion 2. The areas of contact between the first and third parallelepipedic waste ink absorbing portions 1 and 3, and between the second and third parallelepipedic waste ink absorbing portions 2 and 3, are rather small, because the three portions 1, 2 and 3 are simply stacked in layers. Thus, there are minute spaces 14 and 15 between the first and third parallelepipedic waste ink absorbing portions 1 and 3, and between the second and third parallelepipedic waste ink absorbing portions 2 and 3.

The first to third parallelepipedic waste ink absorbing portions 1, 2, and 3 have capillary force. Therefore, as the pigment-based ink 18 is discharged into the slot 10, it is stored in the second parallelepipedic waste ink absorbing portion 2. As the pigment-based ink 18 is absorbed into the second parallelepipedic waste ink absorbing portion 2, it is diffused in the waste ink absorbing member by an ink diffusing force F1 which is generated in the second waste ink absorbing portion 2 in a manner to cause the pigment-based ink 18 to diffuse in the direction indicated by an arrow mark, and an ink diffusing force F2 which is generated in the third waste ink absorbing portion 3 in a manner to cause the pigment-based ink 18 to diffuse in the direction indicated by another arrow mark. However, the overall area of contact between the second and third waste ink absorbing portions 2 and 3 is rather small. Therefore, the pigment-based ink 18 is less liable to diffuse in the direction of the ink diffusing force F2 than in the direction of the ink diffusing force F1.

The relationship in magnitude between the amount of ink diffusing force F1 in the second parallelepipedic waste ink absorbing portion 2, and the ink diffusing force F2 which causes the pigment-based ink to diffuse into the third parallelepipedic waste ink absorbing portion 3 from the second parallelepipedic waste ink absorbing portion 2, is: F1>F2. Therefore, as the second parallelepipedic waste ink absorbing portion 2 increases in the amount of the pigment-based ink therein, the pigment-based ink in the second parallelepipedic waste ink absorbing portion 2 begins to diffuse in the direction of the ink diffusing force F2, and is stored in the third waste ink absorbing portion 3.

Similarly, the overall area of contact between the third and first waste ink absorbing portions 3 and 1 is rather small. Therefore, the pigment-based ink in the third waste ink absorbing portion 3 is less liable to diffuse in the direction of an ink diffusing force F4 than in the direction of the ink diffusing force F3.

Further, the relationship in magnitude between the ink diffusing force F3 and the ink diffusing force F4 is: F3>F4. Therefore, as the third parallelepipedic waste ink absorbing portion 3 increases in the amount of the pigment-based ink therein, the pigment-based ink in the third parallelepipedic waste ink absorbing portion 3 begins to diffuse in the direction of the ink diffusing force F4, and is stored in the first waste ink absorbing portion 1.

The pigment-based inks in the waste ink absorbing portions 2, 3, and 1 quickly diffuse in the directions of the ink diffusing forces F1, F3, and F5, respectively, being therefore unlikely to stagnate in the portions of the parallelepipedic waste ink absorbing portions, which are in the adjacencies of the slot 10. Further, referring to FIG. 4, the evaporative components having evaporated from the dye-based ink and pigment-based ink are held by the evaporation retarding member 106. Therefore, the evaporative components of the pigment-based ink 18 do not quickly evaporate, preventing thereby the non-evaporative components in the pigment-based ink from agglutinating while the pigment-based ink diffuses in the parallelepipedic waste ink absorbing portions.

Figure 6:
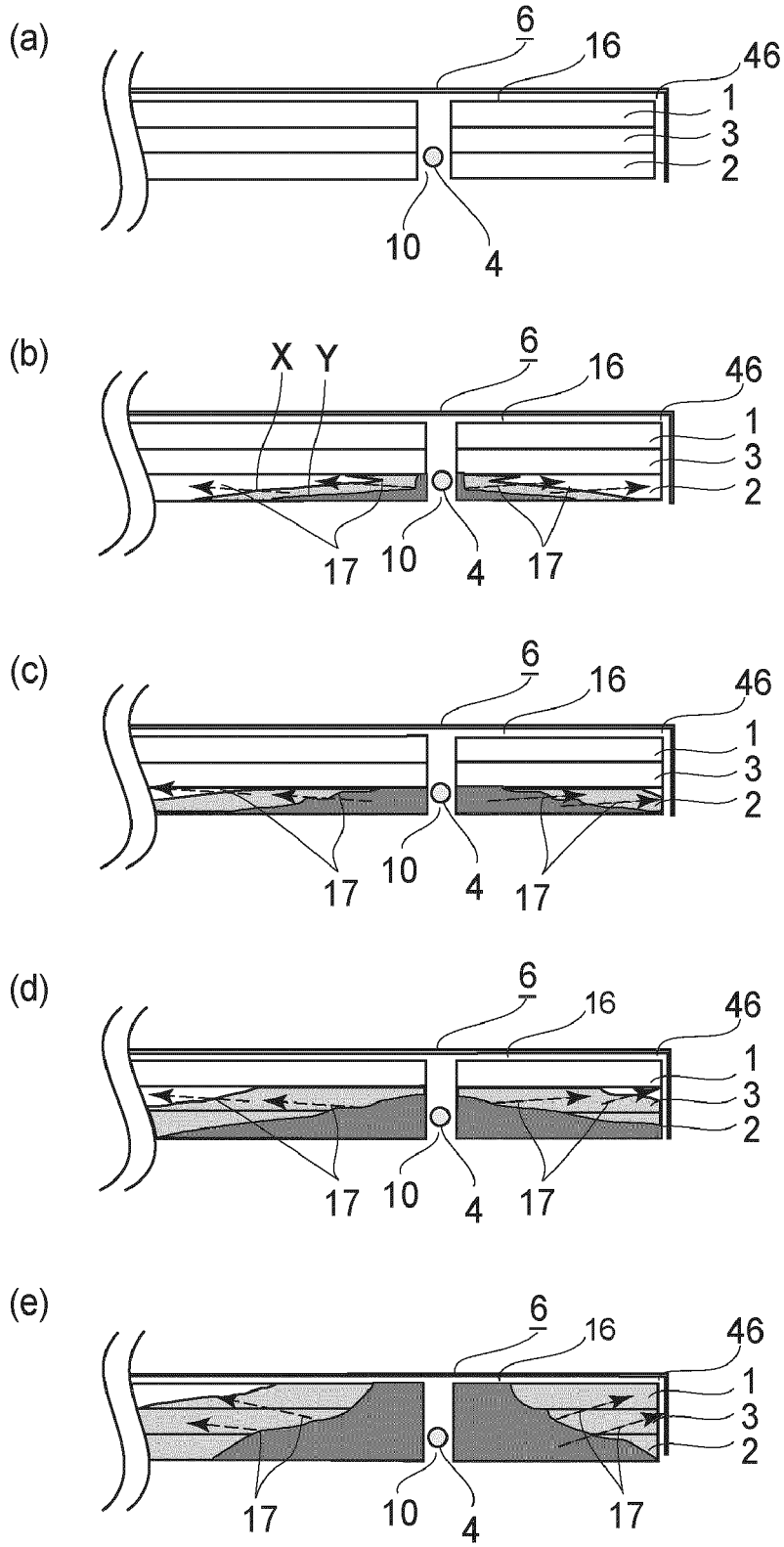
FIG. 6 comprises schematic sectional views of the waste ink storage unit, showing in sequence the changes which occur to the ink retaining areas of the waste ink storage unit shown in FIG. 5, after the waste ink discharge.

In FIGS. 6, (*a*)-(*e*) are schematic sectional views of the waste ink storage unit, showing where and in what manner the pigment-based ink is stored in the waste ink storage unit shown in FIG. 5.

In FIG. 6, (*a*) shows the state of the waste ink storage unit before the pigment-based ink is discharged through the waste ink tube 4, and (*b*), (*c*), (*d*), and (*e*) show where and in what manner the pigment-based ink discharged into the slot 10 is diffused into the parallelepipedic waste ink absorbing portions 2, 3, and 1.

In FIG. 6, (*b*) shows the state of the waste ink storage unit when the amount of the pigment-based ink discharged into the slot 10 is relatively small. In this case, the pigment-based ink in the slot 10 is absorbed into the waste ink absorbing member through the portion of the wall of the slot 10, which corresponds to the second parallelepipedic waste ink absorbing portion 2, and then, is diffused in the direction indicated by an arrow mark 17. The second and third parallelepipedic waste ink absorbing portions 2 and 3 in this embodiment are also simply stacked in layers as shown in FIG. 5. Therefore, there are minute spaces between the parallelepipedic waste ink absorbing portions 2 and 3, making it difficult for the pigment-based ink to diffuse into the third parallelepipedic waste ink absorbing portion 3. Further, the evaporative components of the pigment-based ink in the parallelepipedic waste ink absorbing portion 2 begin to evaporate while being diffused in the direction of the arrow mark 17. As a result, the remaining portions of the pigment-based ink separate into a portion X, that is, a body of solvent which does not contain pigment, and a portion Y (pigment portion Y), that is, a portion which contains a substantial amount of water and the pigment. However, the evaporative components of the pigment-based ink are prevented by the evaporation retarding member 6 from quickly evaporating. Therefore, it is not immediately after the evaporative components of the pigment-based ink begin to evaporate that it becomes impossible for the pigment portion Y to diffuse. That is, the pigment begins to agglutinate after the pigment portion Y diffuses.

In FIG. 6, (*c*) shows the state of the waste ink storage unit when the amount of the discharged pigment-based ink has just reached the full capacity of the portion of the second parallelepipedic waste ink absorbing member 2, which is in the adjacencies of the slot 10. It is when the waste ink absorbing unit is in this condition that the pigment-based ink begins to diffuse into the parallelepipedic waste ink absorbing portion 3 through the areas of contact between the second and third waste ink absorbing portions 2 and 3.

In FIG. 6, (*d*) shows the state of the waste ink storage unit when the amount of the discharged pigment-based ink has just reached the combination of the full capacity of the second parallelepipedic waste ink absorbing portion 2, which is in the adjacencies of the slot 10, and the full capacity of the third parallelepipedic waste ink absorbing portion 3, which is in the adjacencies of the slot 10. It is when the waste ink absorbing unit is in this condition that the pigment-based ink begins to diffuse into the parallelepipedic waste ink absorbing portion 1 through the areas of contact between the first and third waste ink absorbing portions 1 and 3.

In FIG. 6, (*e*) shows the state of the waste ink storage unit when the pigment-based ink has reached the first parallelepipedic waste ink absorbing portion 1. When the waste ink storage unit is in the state shown in (*e*) of FIG. 6, the pigment-based ink has been diffused virtually throughout the parallelepipedic waste ink absorbing portions 2 and 3, having begun to be diffused in the direction of the arrow mark 17 through the areas of contact between the third and first waste ink absorbing portions 3 and 1.

In this stage of diffusion of the pigment-based ink, the pigment-based ink is diffused in the direction of the arrow mark 17 from the slot 10. Therefore, the problem that a large amount of pigment-based ink remains in the portion of the waste ink absorbing member, which is in the adjacencies of the slot 10, does not occur. Therefore, the problem that the non-evaporative components in the pigment-based ink cumulatively solidify on the surface of the slot 10, and within a part or parts of the parallelepipedic waste ink absorbing member, does not occur.

Figure 7:
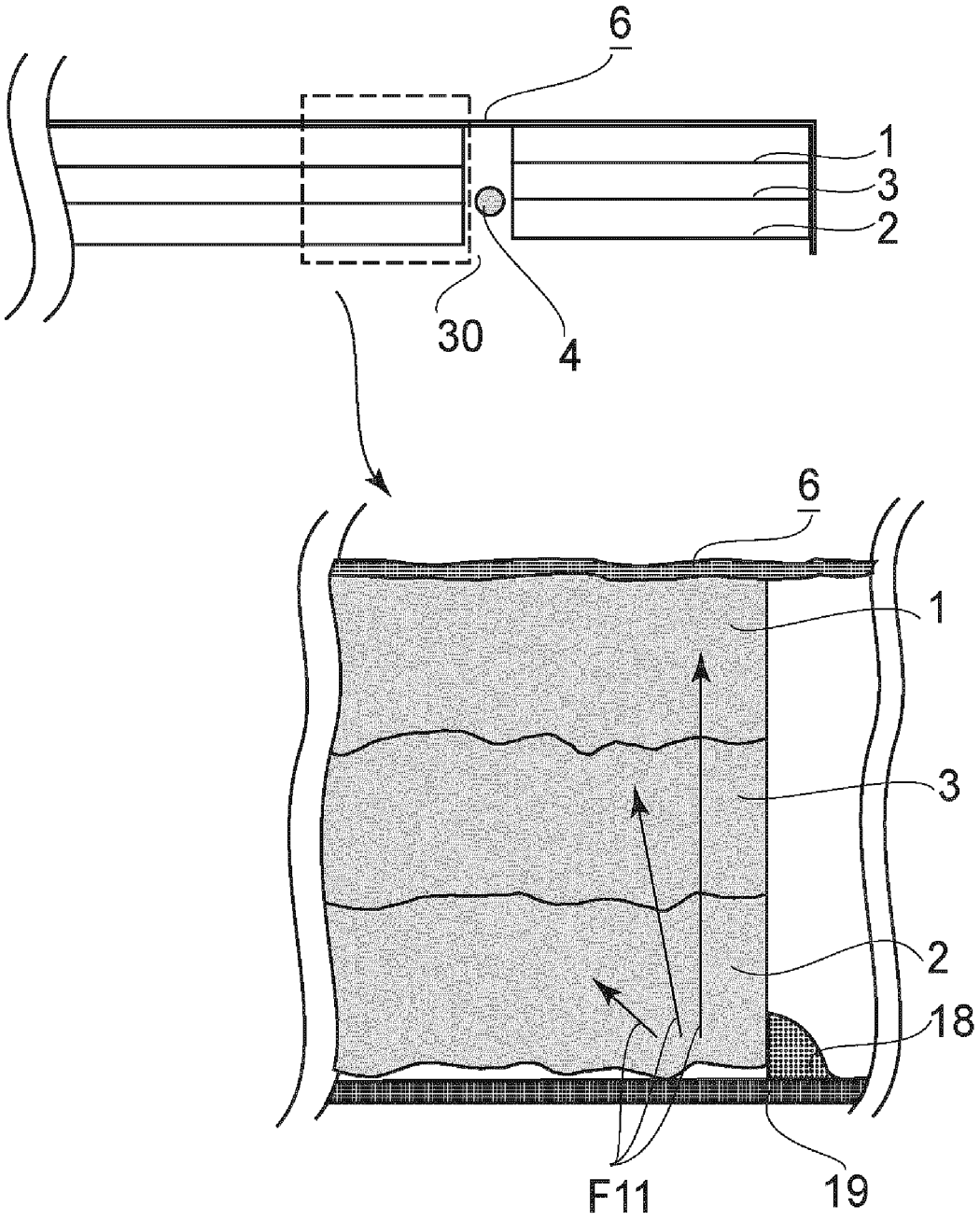
FIG. 7 illustrates a comparative waste ink storage unit, wherein (*a*) is a sectional view of the entirety of the comparative waste ink storage unit to be compared with the waste ink storage unit structured as shown in FIG. 5 to describe the effects of the present invention, and (*b*) is an enlarged schematic sectional view of a part of the comparative waste ink storage unit, showing the direction in which waste ink permeates through the ink absorbing member.

FIG. 7 comprises sectional views of one of the comparative waste ink storage units, which are to be compared with the waste ink storage unit shown in FIG. 5 to describe the effects of the present invention. It shows where and in what manner the pigment-based ink is diffused in the waste ink storage unit in accordance with the prior art.

In FIG. 7, (*a*) is a sectional view of the portion of the waste ink storage unit, into which the pigment-based ink is discharged through the waste ink tube 4, and its adjacencies. The waste ink storage unit is structured so that the waste ink is discharged into the portion of the slot 30, which corresponds to the second parallelepipedic waste ink absorbing portion 2. The discharged pigment-based ink is absorbed into the waste ink absorbing member through the portions of walls of the slot 30, which corresponds to the second parallelepipedic waste ink absorbing portion 2.

The evaporation retarding member 6 and first parallelepipedic waste ink absorbing portion 1 are bonded to each other, or pressed upon each other. Therefore, there are no minute spaces, such as the spaces 16 and 46 shown in (*a*) of FIG. 5, between the evaporation retarding member 6 and first parallelepipedic waste ink absorbing portion 1.

In FIG. 7, (*b*) is an enlarged schematic sectional view of the portion of (*a*) of FIG. 7, which is outlined by a broken line. The parallelepipedic waste ink absorbing portion 2 is bonded to, or kept pressed upon, the bottom wall of the waste ink absorbing member housing 19 of the waste ink storage unit. The third and first parallelepipedic waste ink absorbing portions 3 and 1 are bonded to, or kept pressed upon, the second and third parallelepipedic waste ink absorbing portions 2 and 3, respectively. The area of contact between the second and third parallelepipedic waste ink absorbing portions 2 and 3, and the area of contact between the third and first parallelepipedic waste ink absorbing portions 3 and 1, in this comparative example of waste ink storage unit, are extremely large compared to the corresponding areas of a waste ink storage unit in which the second, third, and first parallelepipedic waste ink absorbing portions 2, 3, and 1 are simply stacked in layers. Therefore, in the case of this comparative example of waste ink storage unit, the force which works in the direction to diffuse the waste ink from the second parallelepipedic waste ink absorbing portion 2 into the third parallelepipedic waste ink absorbing portion 3, and the force which works in the direction to diffuse the waste ink from the third parallelepipedic waste ink absorbing portion 3 into the first parallelepipedic waste ink absorbing portion 1, are significantly larger than that which works in the case of a waste ink storage unit in which the parallelepipedic waste ink absorbing portions are simply stacked in layers.

Each of the parallelepipedic waste ink absorbing portions 1, 2, and 3 has capillary force. Thus, as the pigment-based ink 18 is discharged into the slot 30, it is first absorbed into the second parallelepipedic waste ink absorbing portion 2. Then, the pigment-based ink 18 in the second waste ink absorbing portion 2 is diffused in the directions indicated by arrow marks F11 by the ink diffusing forces generated in the second parallelepipedic waste ink absorbing portion 2, and the ink diffusing force which works in the direction to diffuse the ink from the second parallelepipedic waste ink absorbing portion 2 into the third parallelepipedic waste ink absorbing portion 3.

Similarly, the pigment-based ink in the third parallelepipedic waste ink absorbing portion 3 is diffused in the direction indicated by the arrow marks F11 by the ink diffusing force generated in the third parallelepipedic waste ink absorbing portion 3, and the ink diffusing force which works in the direction to diffuse the pigment-based ink in the third parallelepipedic waste ink absorbing portion 3 into the first parallelepipedic waste ink absorbing portion 1.

The evaporation retarding member 6 retards the evaporation of the evaporative components in the pigment-based ink in the first parallelepipedic waste ink absorbing portion 1, retarding thereby the evaporation of the evaporative components in the evaporative components in the pigment-based ink in the parallelepipedic waste ink absorbing portions 2 and 3. Therefore, the humidity in the parallelepipedic waste ink absorbing portions 1, 2, and 3 remains at roughly the saturation level for a long period of time. Thus, the portions of the parallelepipedic waste ink absorbing portions 1, 2, and 3, which are in the adjacencies of the slot 30, change in wetness. This change in wetness increases the amount of the force which works, in the adjacencies of the slot 30, in the direction to diffuse the pigment-based ink from the second parallelepipedic waste ink absorbing portion 2 into the third parallelepipedic waste ink absorbing portion 3, and from the third parallelepipedic waste ink absorbing portion 3 into the first parallelepipedic waste ink absorbing portion 1.

In comparison, in the case of the waste ink storage unit in which the parallelepipedic waste ink absorbing portions are simply stacked in layers as shown in (*b*) of FIG. 5, the evaporation retarding member 6 is for preventing the evaporation of the evaporative components in the pigment-based waste ink in the parallelepipedic waste ink absorbing portions 2 and 3 from evaporating in the early stage of diffusion of the pigment-based ink in the parallelepipedic waste ink absorbing member, by preventing the evaporative components in the pigment-based ink 18 in the first waste ink absorbing portion 1 from evaporating in the early stage of diffusion of the pigment-based ink into the waste ink absorbing member. However, it does not retard the evaporation of the evaporative components in the pigment-based ink for a long period of time after the discharging of the pigment-based ink. Since the minute spaces 16 and 46 are practically in contact with the outside air through the slot 7 of the evaporation retarding member 6, the evaporative components of the pigment-based ink in the waste ink absorbing member slowly evaporate. Therefore, as time elapses, the humidity in the portion of each of the parallelepipedic waste ink absorbing portions 1, 2, and 3, which is in the adjacencies of the slot 10, equalizes with the humidity of the outside air, making it unlikely for the portion of each of the parallelepipedic waste ink absorbing portions 1, 2, and 3, which is in the adjacencies of the slot 10, to change in wetness.

Figure 8:
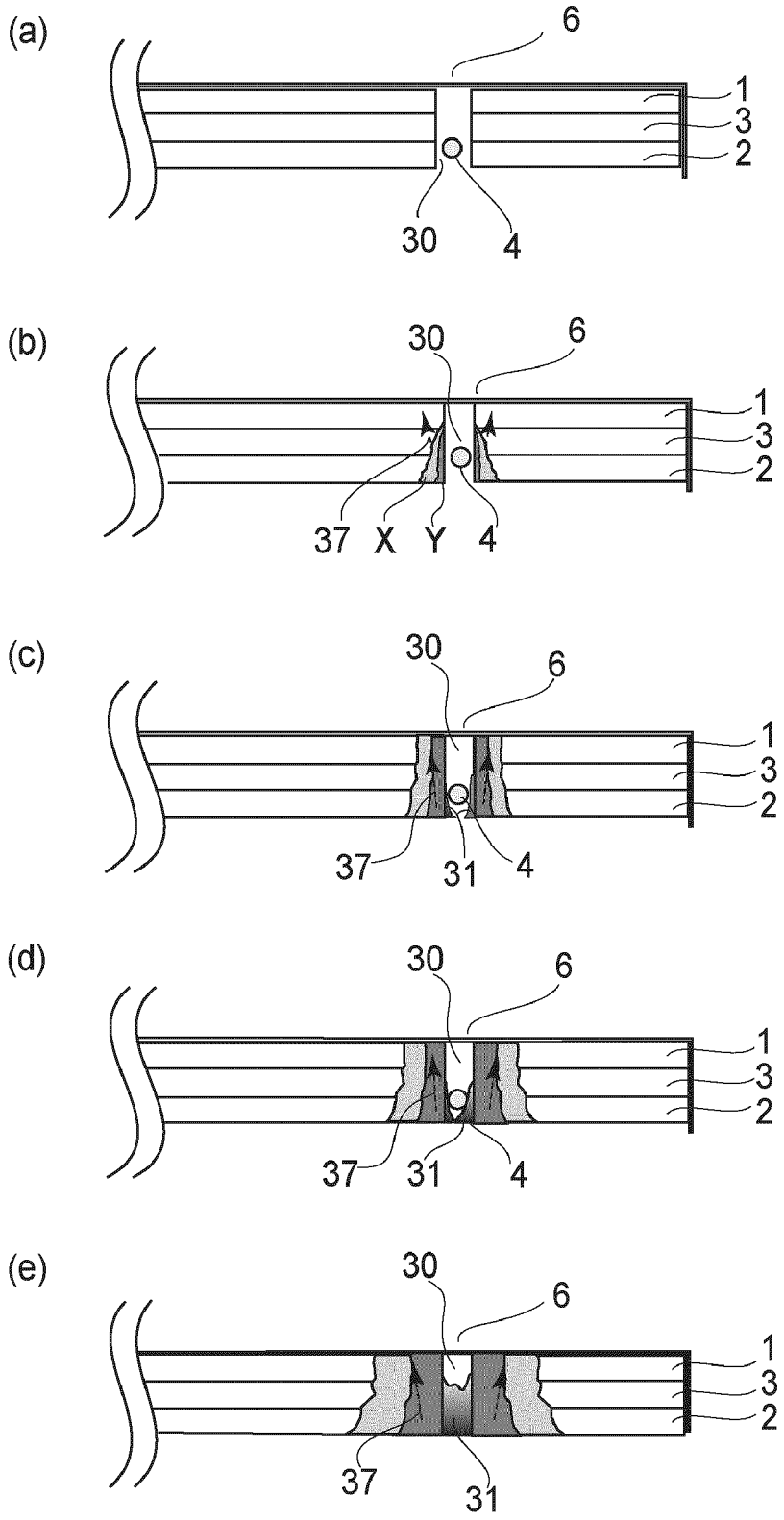
FIG. 8 comprises schematic sectional views of a comparative waste ink storage unit, which correspond to the sectional views of FIG. 6, showing in sequence the changes which occur to the ink retaining areas of the comparative waste ink storage unit after the waste ink discharge.

In FIGS. 8, (*a*)-(*e*) are sectional views of the slot 30, and its adjacencies, of the waste ink storage unit structured as shown in FIG. 7, and progressively shows where and in what manner the pigment-based ink is stored (diffused) in the waste ink storage unit.

In FIG. 8, (*a*) shows the waste ink storage unit before the pigment-based ink is discharged into the waste ink storage unit through the waste ink tube 4, and (*b*), (*c*), (*d*), and (*e*) progressively show where and in what manner the pigment-based ink diffuses in the parallelepipedic waste ink absorbing portions 1, 2, and 3 from the slot 30 after it is discharged into the slot 30.

In FIG. 8, (*b*) shows the waste ink storage unit when the amount by which the pigment-based ink has been discharged into the slot 30 is relatively small. In this stage, the discharged pigment-based ink is being absorbed into the waste ink absorbing member through the portions of the wall of the slot 30, which corresponds to the second waste ink absorbing portion 2, and is diffusing in the direction indicated by arrow marks 37. Since the third parallelepipedic waste ink absorbing portion 3 is bonded to, or kept pressed upon the second parallelepipedic waste ink absorbing portion 2, as shown in FIG. 7, the pigment-based ink in the second parallelepipedic waste ink absorbing portion 2 is diffused into the third parallelepipedic waste ink absorbing portion 3. Further, the evaporative components in the pigment-based ink in each of the first to third parallelepipedic waste ink absorbing portions 1, 2, and 3 begin to evaporate while the pigment-based ink is diffused in the direction of the arrows 37, causing the pigment-based ink to separate into a solvent portion X, which does not contain the pigment, and a pigment portion Y, that is, a portion which contains the pigment and a substantial amount of water. Incidentally, it is not immediately after the evaporative components of the pigment-based ink begin to evaporate, that it becomes impossible for the pigment portion Y to diffuse. That is, since the evaporative components of the pigment-based ink are prevented by the evaporation retarding member 6 from quickly evaporating, it is after the diffusion of the portion Y that the pigment begins to agglutinate.

When the waste ink storage unit is in the state shown in (*c*) of FIG. 8, more pigment-based ink has been discharged, and diffused in the direction indicated by an arrow mark 37 through the adjacencies of the slot 30 of the parallelepipedic waste ink absorbing member, all the way to the top surface of the waste ink absorbing member (first parallelepipedic waste ink absorbing portion 1). In this stage of diffusion, the non-evaporative components in the pigment-based ink have begun to agglutinate, and cumulatively precipitate, yielding thereby a deposit 31, on the bottom portion of the wall of the slot 30 of the parallelepipedic waste ink absorbing member, while diffusing in the direction indicated by the arrow mark 37.

Referring to (*d*) of FIG. 8, as the amount of discharged pigment-based ink increases further, the deposit 31 from the pigment-based ink grows larger, eventually large enough to confine the waste ink discharged through the waste ink tube 4, and continues to grow.

Referring to (*e*) of FIG. 8, as the deposit 31 from the pigment-based ink further grows in the slot 30, it buries the waste ink discharging end of the waste ink tube 4, preventing thereby the pigment-based waste ink from being properly discharged through the waste ink tube 4. With the waste ink discharging end of the waste ink tube 4 buried in the deposit 31, it cannot be ensured that ink is reliably ejected from the ink jet head. Further, as the deposit 31 from the pigment-based waste ink grows like a piece of stalactite, it pushes up the evaporation retarding member 6, causing the pigment-based ink to leak.

Figure 9:
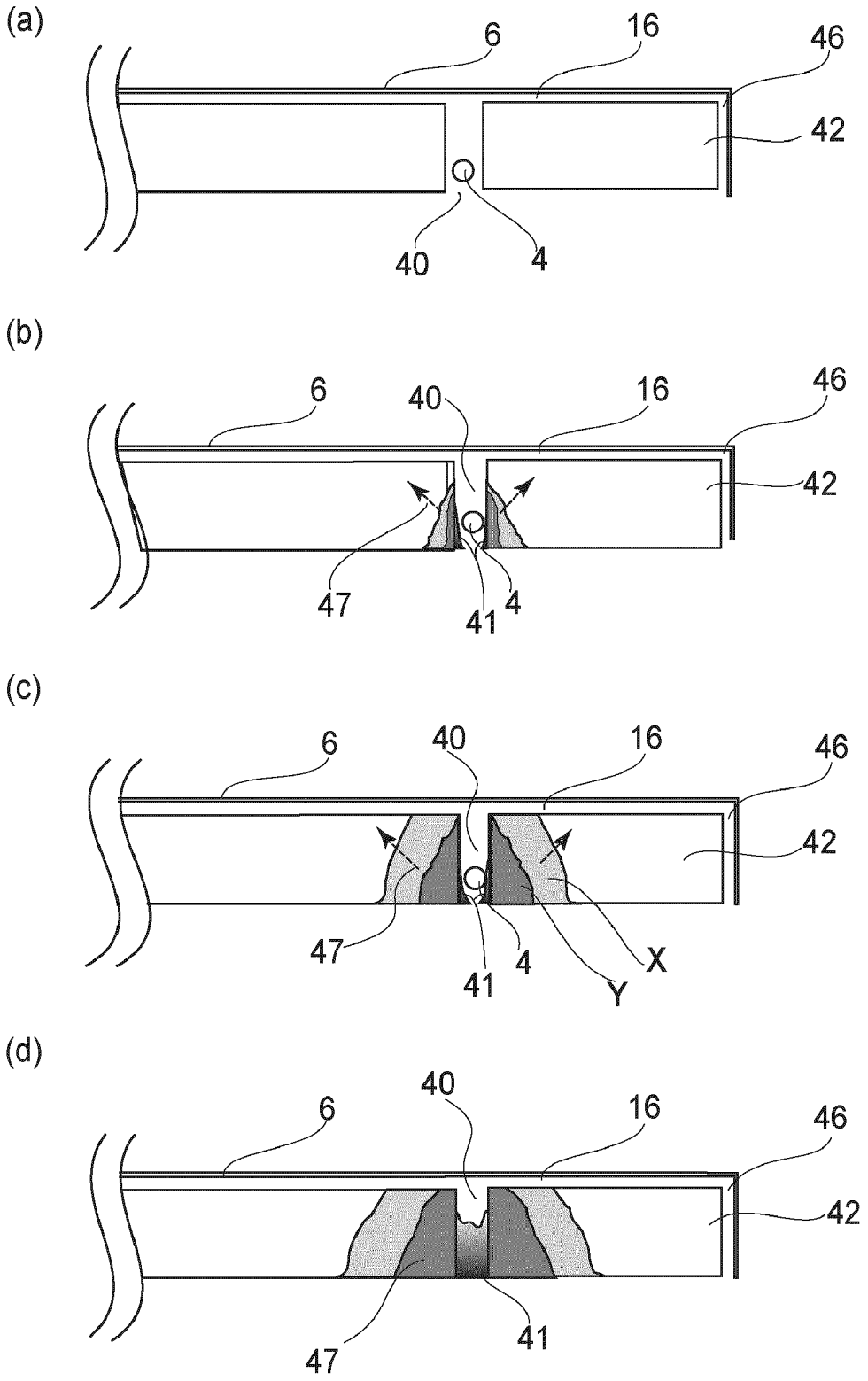
FIG. 9 comprises schematic sectional views of a comparative waste ink storage unit, which correspond to the sectional views of FIG. 6, showing in sequence the changes which occur to the ink retaining areas of the comparative ink storage unit made up of only a single waste ink absorbing portion.

FIG. 9 comprises schematic sectional views of one of the comparative waste ink storage units, which is for describing the effects of the waste ink storage unit in accordance with the present invention, shown in FIG. 6. The views show where and in what manner pigment-based waste ink diffuses in the parallelepipedic waste ink absorbing member after its discharge into the comparative waste ink storage unit.

In FIG. 9, (*a*) shows the state of the comparative waste ink storage unit before the discharge of the pigment-based waste ink. There is a space between the evaporation retarding member 6 (which is for preventing the evaporative components of the pigment-based waste ink from evaporating from the parallelepipedic waste ink absorbing member 42) and parallelepipedic waste ink absorbing member 42 (which is made up of a single parallelepipedic piece of ink absorbing material). In FIG. 9, (*b*), (*c*), and (*d*) progressively show where and in what manner the pigment-based waste ink diffuses from the slot 40 into the parallelepipedic waste ink absorbing member 42 after the ink is discharged into the slot 40.

In FIG. 9, (*b*) shows the state of waste ink storage unit, in which the amount by which the pigment-based waste ink has been discharged into the hollow 40 is very small. When the waste ink storage unit is in this state, the pigment-based waste ink is absorbed into the parallelepipedic waste ink absorbing member 42 through the bottom portion of the wall of the slot 40, and is omnidirectionally diffused as indicated by arrow marks 47. Further, the evaporative components of the pigment-based waste ink in the parallelepipedic waste ink absorbing member 42 have begun to evaporate while the pigment-based waste ink has begun to be diffused in the direction indicated by the arrow marks 47. As a result, the pigment-based waste ink has begun to separate into a solvent portion X and a pigment portion Y. The solvent portion X does not contain pigment. The pigment portion Y contains pigment as well as a substantial amount of water. However, it is not immediately after the starting of the evaporation of the evaporative components of the pigment-based waste ink that it is becomes impossible for the pigment portion Y to diffuse. That is, because the evaporation retarding member 6 prevents the evaporative components of pigment-based waste ink in the parallelepipedic waste ink absorbing member 42 from quickly evaporating, the agglutination of the pigment in the pigment-based waste ink begins after the diffusion of the pigment portion.

In FIG. 9, (*c*) shows the next state of waste ink storage unit, in which more pigment-based waste ink has been discharged into the slot 40. When the waste ink storage unit is in this state, the pigment-based waste ink, which was in the portion of the parallelepipedic waste ink absorbing member 42, which is in the adjacencies of the slot 40, has omnidirectionally diffused further into the parallelepipedic waste ink absorbing member 42 as indicated by the arrow marks 47. As the pigment-based waste ink has begun to advance in the directions indicated by the arrow marks 47, the pigment in the pigment-based waste ink has begun to agglutinate and cumulatively precipitate, yielding thereby a deposit 41, on the portion of the wall of the slot 40, which is in the adjacencies of the waste ink discharging end of the waste ink tube 4.

In FIG. 9, (*d*) shows the next state of waste ink storage unit, in which the deposit 41 has significantly grown in the adjacencies of the waste ink discharging end of the waste ink tube 4, having virtually buried the waste ink discharging end of the waste ink tube 4. When the waste ink storage unit is in this state, it is impossible for the pigment-based waste ink to be properly discharged through the waste ink tube 4. Therefore, it is impossible to ensure that ink is reliably ejected from the ink jet head. Further, as the pigment deposit 41 from the pigment-based waste ink grows like a piece of stalactite, it pushes up the evaporation retarding member 6 (humidity retaining member), allowing the pigment-based waste ink to leak.

<Waste Ink Absorbing Member>

The waste ink absorbing member is not limited in material, as long as a substance selected as the material for the waste ink absorbing member provides the waste ink absorbing member with capillary force. For example, urethane foam, woven or unwoven material formed of polyester fiber or the like, a piece of pulp, and the like, are desirable as the material for the waste ink absorbing member, because they are highly absorbent. It is desired that the waste ink absorbing member causes the waste ink to diffuse in the directions indicated by arrow marks F1, F3, and F5 in (*b*) of FIG. 5. In a case where a fibrous substance is used as the material for the waste ink absorbing member, it is desired that the fibers in the fibrous substance extend in the directions indicated by the arrow marks F1, F3, and F5.

In a case where a waste ink absorbing member is made up two or more waste ink absorbing portions stacked simply in layers, a waste ink absorbing member, the waste ink absorbing portions of which are the same in material, is higher in ink storage efficiency than a waste ink absorbing member, the waste ink absorbing portions of which are different in material.

A waste ink absorbing member impregnated with organic solvent for preventing the agglutination of the non-evaporative components (pigment) of pigment-based ink absorbs the moisture in the air in the waste ink absorbing member, being therefore liable to cause the non-evaporative components (pigment) of pigment-based ink to agglutinate before the pigment-based ink is diffused in the waste ink absorbing member. Therefore, a waste ink absorbing member must not contain the organic solvent.

Here, "does not contain organic solvent" means that (1) volatile organic solvent is not remaining in a waste ink absorbing member before the initial usage of the waste ink absorbing member, and (2) a waste ink absorbing member does not contain nonvolatile (hygroscopic) organic solvent. The presence of volatile organic solvent in a waste ink absorbing member is not problematic as long as the volatile organic solvent completely evaporates before the initial usage of the waste ink absorbing member. However, if volatile organic solvent remains in a waste ink absorbing member for a long time, it is detrimental to the satisfactory realization of the effects of the present invention. It should be noted here that it is very important that a waste ink absorbing member has not been processed with organic solvent after its production; organic solvent is not present in a waste ink absorbing member (portion) immediately before its initial usage. In other words, it does not matter that the waste ink absorbing member in an ink jet recording apparatus contains the water and/or organic solvent from the waste ink discharged, because the ink jet recording apparatus was used.

<Evaporation Retarding Member>

There is no limitation to the material for an evaporation retarding member. All that is required of the material for an evaporation retarding member is that it is non-hygroscopic, and is capable of retarding the evaporation of the evaporative components (water, in particular) of the waste ink in the waste ink absorbing portion(s). If a waste ink absorbing member is formed of a hygroscopic substance, the waste ink absorbing member absorbs the moisture in the air in the waste ink absorbing member, being therefore liable to cause the non-evaporative components (pigment) of the pigment-based waste ink to agglutinate before the pigment-based waste ink diffuses.

Further, the waste ink storage unit is structured so that a space 16 is provided between the parallelepipedic waste ink absorbing member 1 and evaporation retarding member 6 as shown in FIG. 5(*a*). As for the means for providing the space 16, a plate shaped wavy, or irregular, in cross section may be simply placed on the parallelepipedic waste ink absorbing member 1. Shaping the evaporation retarding member 6 wavy, or irregular, in cross section, reduces in size the overall area of contact between the evaporation retarding member 6 and parallelepipedic waste ink absorbing member 1, providing thereby multiple minute spaces 16, instead of the single space 16.

Further, in this case, the space, which is very small in height, is provided between the evaporation retarding member and waste ink absorbing member. However, as long as a space, such as the space 16 or minute spaces, through which the parallelepipedic waste ink absorbing member (portion) are allowed to be practically in connection to the outside air, the edges of the evaporation retarding member 6 may be bonded to the waste ink absorbing member.

Further, from the standpoint of providing a space which is very small in height, between the evaporation retarding member and waste ink absorbing member, the evaporation retarding member may be provided with a hole or holes.

In consideration of the fact that an evaporation retarding member must be placed above a waste ink absorbing member which is limited in surface area size, an evaporation retarding member is desired to be formed of a thin sheet of one of the aforementioned substances. For example, it is desired to be formed of a thin sheet of polyester, or a thin sheet of polyester coated with a layer of SiOx placed by vapor deposition.

Incidentally, the minimum requirement regarding the structure of an evaporation retarding member is that the dimension of the left and right portions of the evaporation retarding member, relative to the slot 7 of the evaporation retarding member, is twice or more the width (in terms of left-to-right direction in FIG. 2) of the slot 7 of the evaporation retarding member. Further, the dimension of the evaporation retarding member (in terms of the direction perpendicular to the left-to-right direction of FIG. 2) is 1.5 time the dimension of the portion of the waste ink absorbing member, which is in the adjacencies of the slot 10. That is, it is large enough for the evaporation retarding member to cover roughly the entirety of the portion of the waste ink absorbing member, which is behind the slot 10.

Next, preferable examples of ink, coloring agent, etc., among the inks, coloring agents, etc., which are compatible with the present invention, will be described.

(Description of Inks and Coloring Agents)

Next, the examples of ink, coloring agent, etc., which are preferable to the present invention will be described. The following examples of ink, coloring agent, etc., are not intended to limit the present invention in scope. That is, the present invention works just as well with any ink, coloring agent, etc., as long as they are similar in properties regarding agglutination as the following examples, which is needless to say.

The effects of the present invention are more conspicuous when an ink jet recording apparatus equipped with a waste ink storage unit in accordance with the present invention is used with an ink which has been improved in that it was rendered less likely to bleed. One of the examples of such ink is an ink, the coloring agent of which is self-diffusing pigment (carbon black and the like), that is, pigment which is directly, or indirectly (through another group(s) of atoms), bonded to hydrophillic radical(s). Another example of such ink is an ink which contains multiple hygroscopic organic solvents, at least one of which is a water-soluble organic solvent. A water-soluble organic solvent is a "weak" solvent in that it is a hindrance to the stable diffusion of pigment-based ink in a waste ink absorbing portion. In a case where an ink, such as the above described ones, is deposited on recording medium, the pigment in pigment-based ink begins to agglutinate in the top surface portion of recording medium as the water in the pigment-based ink evaporates, because the evaporation of the water in the pigment-based ink increases the ratio of the pigment relative to "weak" solvent increases.

Therefore, whether a pigment-based ink is deposited on a portion of recording medium, which is away from the portion of recording medium, on which another ink has been deposited, or on a portion of recording medium, which borders the portion of recording medium, on which another ink has been deposited, bleeding does not occur. Further, when a pigment, the particles of which are highly densely covered with hydrophillic radicals, is used as coloring agent, the above described advantage is more conspicuous. This type of pigment is less compatible with the solvent in ink than a conventional self-diffusing pigment. Therefore, even if it is only by a very small amount that the water in pigment-based ink evaporates, pigment diffusion becomes unstable. As a result, "bleeding" reduces.

Incidentally, the abovementioned "weak" solvent means such solvent that has the following properties:

"After a solution which contains a solvent in question by roughly 50% in mass, and in which the pigment, which is to be used as the coloring agent for ink, has been diffused, and a solution which does not contain the solvent in question, or contains a small amount of the solvent in question, and in which the pigment, which is to be used as the coloring agent for ink, has been diffused, are left unattended for 48 hours at 60° C., the diameter of the particles in the former is greater than the diameter of the particles in the latter". A "good" solvent is any solvent which displays the properties other than the properties of a "weak" solvent.

Embodiment 1

Hereafter, the present invention will be more concretely described with reference to the preferred embodiments of the presented invention, and comparative waste ink storage units. The following embodiments of the present invention are not intended to limit the present invention in scope as long as they do not overstep the gist of the present invention. Further, unless specifically noted, the unit used to describe the amount of each ingredient in the preferred embodiments and comparative inks is "part in mass".

<Ink>

(Production of Black Ink, or Solution Containing Black Pigment)

A solvent made by dissolving 5 g of concentrated hydrochloric acid into 5.5 g of water was cooled to 5° C. Then, to this solvent, 4.65 g of p-aminobenzoic acid was added while the temperature of the solvent was kept at 5° C. Next, the container in which the solvent was kept was placed in an ice-bath, and the temperature of the solution was kept no higher than 10° C. by stirring the solution. Then, to this solution, a solution made by dissolving 1.8 g of sodium nitrite into 9 g of water, which was 5° C. in temperature, while the temperature of the solution was kept no higher than 10° C. The thus obtained solution was stirred for 15 minutes. Next, to this solution, 20 g of carbon black which was 220 $m^2$ in specific surface area and 105 ml/100 g in the amount of DBP absorption, was added while stirring the combination. Thereafter, the combination was stirred for 15 minutes, yielding slurry. Then, the slurry was filtered with a paper filter (commercial name: Standard Paper Filter No. 2, product of Advantech). Then, the obtained particles were thoroughly washed with water. Then, the particles were dried in an oven, the temperature of which was kept at 110° C., yielding thereby self-diffusing carbon black. Further, water was added to the self-diffusing carbon black obtained through the above-described process, to yield a water solution of the pigment, the pigment density of which was 10% in mass. With the use of the above-described method, the water solution of pigment, in which self-diffusing carbon black particles were covered with —$C_6H_4$—COONa radicals, was obtained.

(Production of Dye for Color Inks)

(Cyan Dye)

As the cyan dye, C.I. Direct Blue 199 was used.

(Magenta Dye)

The chemical compound expressible by the following formula (Formula (1)), sodium carbonate, and ethyl-benzoyl acetate ester, were made to react in xylene. The obtained chemical compound was filtered and washed clean. Then, the cleaned chemical compound was made to react with met aminoacetanilide, copper acetate, sodium carbonate, by sequentially adding them, in N,N-dimethylformamide. Then, the obtained chemical compound was washed clean, and sulfonated in smoking sulfuric acid. Then, the obtained chemical compound was filtered, and washed clean. Then, the cleaned chemical compound, and cyanurchlorid, were made to condense with the presence of sodium hydroxide. To the thus obtained solution, anthranilic acid was added. Then, the combination was made to condense with the presence of sodium hydroxide. Then, the obtained chemical compound was washed clean, yielding the magenta dye having the following chemical structure, Formula (2).

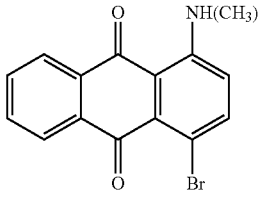

(Yellow Dye)

As the yellow dye, C.I. Direct Yellow 132 was used.

(Manufacturing of Ink)

The ingredients shown in the following table, Table 1, were mixed, and thoroughly stirred. Then, the obtained mixture was filtered, while applying pressure, with a membrane filter with a pore size of 0.2 μm (which was 3.0 μm when manufacturing black pigment). The thus obtained set of inks was very unlikely to bleed. The particles in the pigment-based black ink are highly agglutinative. That is, the particles in the pigment-based black ink waste are likely to agglutinate even if the amount of water having evaporated from the waste ink is very small. In other words, the effects of the present invention is most conspicuous when an ink jet recording apparatus equipped with a waste ink absorbing unit in accordance with the present invention is used with the pigment-based black ink manufactured using the above described method.

TABLE 1

| | | Chromatic inks | | |
|---|---|---|---|---|
| | Bk-ink | C-ink | M-ink | Y-ink |
| Pig. dispersion liquid | 40.0 | — | — | — |
| Cyan dye | — | 5.0 | — | — |
| Magenta dye | — | — | 5.0 | — |
| Yellow dye | — | — | — | 3.0 |
| Glycerin | 8.0 | 10.0 | 10.0 | 10.0 |
| Diethylene glycol | 6.0 | 10.0 | — | 10.0 |
| Urea | — | 10.0 | 10.0 | 10.0 |
| Diammonium phthalate | 1.0 | — | — | — |
| Pyrrolidone | 6.0 | — | 5.0 | — |
| Acetylenol E100 *1 | 0.2 | 1.0 | 1.0 | 1.0 |
| Water | 38.8 | 64.0 | 69.0 | 66.0 |

*1 ethylene oxide adduct of acetylene glycol, available from KAWAKEN Finechemical Co., Japan (Evaporation Retarding Member)

As the material for the evaporation retarding member, PET film (which is 0.1 mm in thickness) was used.

(Ink Jet Recording Apparatus)

An ink jet recording apparatus provided with a waste ink storage portion, such as the one shown in FIG. 2, which was made up of three parallelepipedic waste ink absorbing portions which were simply stacked in layers, and an evaporation retarding member, was used, although the fourth comparative waste ink absorbing portion did not have an evaporation retarding member. As the material for the waste ink absorbing portion, pulp was used. However, the material for the waste ink absorbing portion may be urethane foam, woven or unwoven material made of polyester fiber, or the like, instead of pulp. The abovementioned materials for the waste ink absorbing portion are not intended to limit the present invention in scope. The capacity of the waste ink absorbing member was made to be equivalent to 10,000 ordinary copies.

Hereafter, the waste ink absorbing unit (member, portion) in the first to fourth embodiments, first to fourth referential waste ink absorbing unit (member, portion), and first and second comparative waste ink absorbing unit (member, portion), will be described.

Embodiment 1

Figure 10:
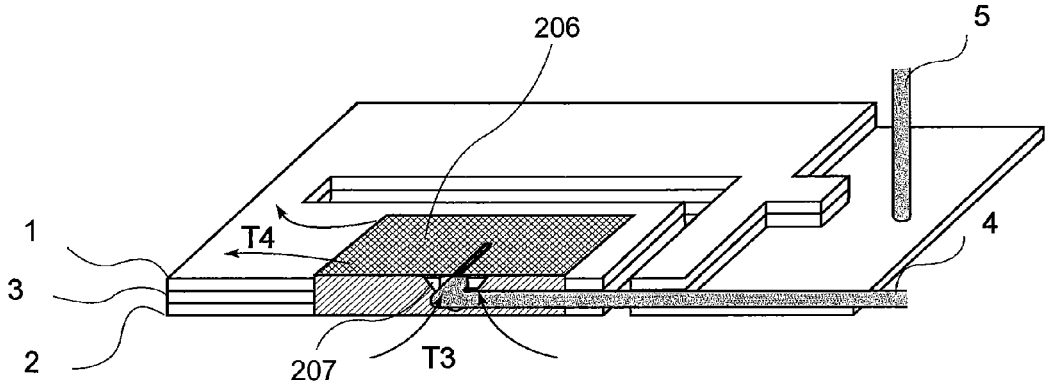
FIG. 10 is a perspective view of one of the modified versions of the evaporation retarding member in the first embodiment of the present invention.

Referring to FIG. 10, the waste ink absorbing unit in this embodiment is made up of three parallelepipedic waste ink absorbing portions stacked simply in layers, and an evaporation retarding member placed above the top ink absorbing portion with the provision of a space with a height of roughly 1 mm between the evaporation retarding member and top waste ink absorbing portion. The portion of the evaporation retarding member which covers the top surface of the top waste ink absorbing portion is 50% in size of the top surface of the top waste ink absorbing portion intended for absorbing the pigment-based black waste ink.

Embodiment 2

Figure 11:
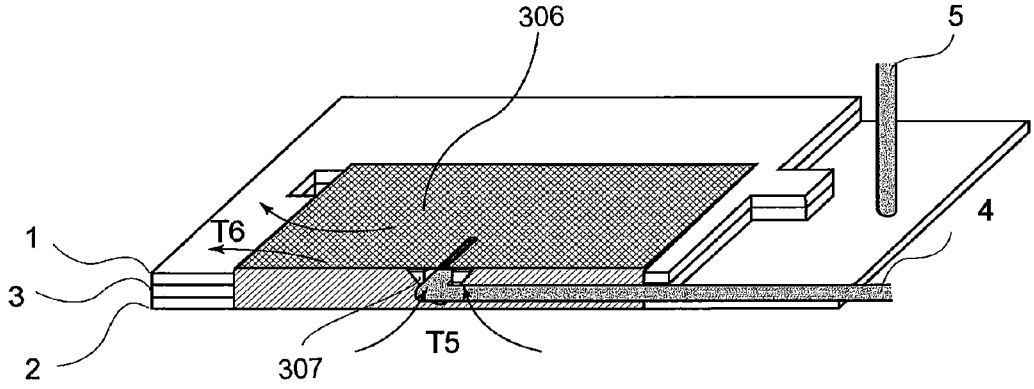
FIG. 11 is a perspective view of another of the modified versions of the evaporation retarding member in the first embodiment of the present invention.

Referring to FIG. 11, the waste ink absorbing unit in this embodiment is also made up of three parallelepipedic waste ink absorbing portions stacked simply in layers, and an evaporation retarding member placed above the top ink absorbing portion with the provision of a space with a height of roughly 1 mm between the evaporation retarding member and top waste ink absorbing portion. The evaporation retarding member has two walls. The portion of the evaporation retarding member which covers the top surface of the top waste ink absorbing portion is 80% in size of the top surface of the top waste ink absorbing portion intended for absorbing the pigment-based black waste ink.

Embodiment 3

Referring to FIG. 2, the waste ink absorbing unit in this embodiment is made up of three parallelepipedic waste ink absorbing portions stacked simply in layers, and an evaporation retarding member placed above the top ink absorbing portion with the provision of a space with a height of roughly 1 mm between the evaporation retarding member and top waste ink absorbing portion. The evaporation retarding member has four walls. The portion of the evaporation retarding member which covers the top surface of the top waste ink absorbing portion is 80% in size of the top surface of the top waste ink absorbing portion intended for absorbing the pigment-based black waste ink.

Embodiment 4

Referring to FIG. 4, the waste ink absorbing unit in this embodiment is made up of three parallelepipedic waste ink absorbing portions stacked simply in layers, and an evaporation retarding member placed above the top ink absorbing portion, with the provision of a space with a height of roughly 1 mm between the evaporation retarding member and top waste ink absorbing portion. The evaporation retarding member has five walls. The portion of the evaporation retarding member which covers the top surface of the top waste ink absorbing portion is 80% in size of the top surface of the top waste ink absorbing portion intended for absorbing the pigment-based black waste ink, and is 40% in size of the top surface of the dye-based waste ink absorbing area of the top waste ink absorbing portion.

<Referential Waste Ink Absorbing Unit 1>

This ink absorbing unit is the same as the waste ink absorbing unit in the second embodiment, except that the top parallelepipedic waste ink absorbing portion and evaporation retarding member of this unit is airtightly in contact with each other.

<Referential Waste Ink Absorbing Unit 2>

This ink absorbing unit is the same as the waste ink absorbing unit in the second embodiment, except that the top parallelepipedic waste ink absorbing portion and evaporation retarding member of this unit is airtightly in contact with each other, and also, that the portion of the first parallelepipedic waste ink absorbing portion, which is in the adjacencies of the discharging end of the waste ink tube, is impregnated with 5 g of agglutination preventing liquid manufactured using the following materials and method.

(Evaporation Preventing Liquid)

The following ingredients are mixed and thoroughly stirred. Then, the mixture was filtered under pressure, with a membrane filter with a pore size of 3.0 μm, yielding the agglutination preventing liquid.

Glycerin: 75% in weight

Acetylenol E100 (Kawaken Fine Chemical Co., Ltd.): 0.05% in weight

Water: 24.95% in weight.

<Referential Waste Ink Absorbing Unit 3>

This ink absorbing unit is the same as the first referential waste ink absorbing unit, except that the portion of the first parallelepipedic waste ink absorbing portion, which is in the adjacencies of the discharging end of the waste ink tube, is impregnated with 5 g of agglutination preventing liquid manufactured using the above described materials and method.

<Referential Waste Ink Absorbing Unit 4>

This waste ink absorbing unit does not have an evaporation retarding member, and the waste ink absorbing member is not impregnated with the agglutination preventing liquid.

<Comparative Waste Ink Absorbing Unit 1>

Referring to FIG. 9, this waste ink absorbing unit is made up of a single waste ink absorbing portion, and an evaporation retarding member placed above the waste ink absorbing portion, with the provision of a space with a height of roughly 1 mm.

<Comparative Waste Ink Absorbing Unit 2>

Referring also to FIG. 9, this waste ink absorbing unit is made up of a single waste ink absorbing portion, and an evaporation retarding member placed above the waste ink absorbing portion, with the provision of a space with a height of roughly 1 mm. Further, the surface layer of the waste ink absorbing portion, which directly comes into contact with the waste ink, is impregnated with 5 g of the agglutination preventing liquid manufactured with the use of the above described ingredients and method.

(Testing Method)

The ink jet recording apparatuses, in which ink containers filled with the black ink and color inks manufactured with the use of the above described ink manufacturing methods, and fitted with the waste ink absorbing units in the above described embodiments of the present invention, referential waste ink absorbing units, and comparative waste ink absorbing units, were mounted, were subjected to tests in which the temperature and humidity were 30° C. and 10% RH, respectively, and a single page of document (pattern) was printed in black every two minutes. The preparatory ejection or suction of ink, which is for keeping the ink jet head normal in ink ejection performance, was carried out with the use of a modified version of BJS-600 (produce of Canon).

(Evaluation Method)

The waste ink absorbing units were evaluated in waste ink absorbency, with naked eye, using the following criteria:

Visual Evaluation Criteria

G: waste ink absorbing portion thoroughly absorbed waste ink, and no agglutination and deposition of ink ingredients were visually detectable.

N: waste ink absorbing portion failed to thoroughly absorb waste ink, and deposition of ink ingredients and/or growth of deposition along the wall of the waste ink receiving slot of the waste ink absorbing portion was visually detectable.

(Results of Evaluation)

The results of evaluation are given in Table 2. The changes in the waste ink absorbency of the waste ink storage units in the preferred embodiments, and those of the comparative waste ink storage units, are shown in FIGS. 6, 8, and 9.

TABLE 2

| | Absorbing power at 8000 shts | Number of prints at occurrence of deposition growth |
|---|---|---|
| Embodiment 1 | G | 11,000 |
| Embodiment 2 | G | 12,000 |
| Embodiment 3 | G | — |
| Embodiment 4 | G | — |
| Ref. Ex. 1 | N | 4,000 |
| Ref. Ex. 2 | N | 4,000 |
| Ref. Ex. 3 | N | 5,000 |
| Ref. Ex. 4 | N | 5,000 |
| Comp. Ex. 1 | N | 4,000 |
| Comp. Ex. 2 | N | 3,000 |

As will be evident from the results given above, in the case of the waste ink storage units in the first to fourth preferred embodiments of the present invention, the non-evaporative components of the waste ink did not deposit or accumulate along the wall of the waste ink receiving slot of the waste ink absorbing member, even when 10,000 copies were printed. Further, in the case of the waste ink storage units in the third and fourth embodiments, even when 10,000-14,000 copies of an ordinary (standard) were printed, the deposition did not occur, and the waste ink diffused throughout the portion of the waste ink absorbing member, which are intended for pigment-based black waste ink; in other words, the waste ink absorbing member was effectively and thoroughly used. In comparison, in the case of the referential waste ink storage units and comparative waste ink storage units, the non-evaporative components of the waste ink began to deposit in the adjacencies of the waste ink discharging opening of the waste ink tube, or along the wall of the waste ink receiving slot of the waste ink absorbing member, before the copy count reached 50% of the number of copies printed by the ink jet recording apparatuses fitted with the waste ink storage units in the first to fourth embodiments; in other words, the absorbency of the waste ink absorbing member was not fully utilized. In addition, the waste ink tube was plugged by the non-evaporative components of the waste ink, which deposited in the adjacencies of the waste ink discharging opening of the waste ink tube, making it impossible to satisfactorily suction ink for maintenance.

POSSIBLE INDUSTRIAL APPLICATION OF PRESENT INVENTION

The present invention, which is very effective when it is applied to a waste ink absorbing unit (member, portion) for absorbing waste ink which contains self-diffusing pigment, can also be applied to a waste ink absorbing unit (member, portion) for absorbing capsuled ink, ink which contains pigment made up of resin, etc., the non-evaporative components of which are liable to agglutinate. It can also be applied to a waste ink absorbing unit for absorbing waste ink which contains water-soluble dye, the molecules of which are liable to associate. Further, although the present invention is most effective when it is applied to an ink jet recording apparatus, it is also applicable to most of the ink jet recording apparatuses which record with the use of water base ink(s) other than those described above.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 148501/2007 and 110440/2008 filed Jun. 4, 2007 and Apr. 21, 2008, respectively, which are hereby incorporated by reference.

What is claimed is:

1. A residual ink container comprising:

laminated members for absorbing waste ink not used for recording, wherein said laminated members are laminated with a gap between adjacent laminated members; and a covering member covering such that a non-contact portion is provided between said covering member and a topmost member of said laminated members so as not to press against said topmost member, wherein at least the topmost member of said laminated members does not contain organic solvent.

2. A container according to claim 1, wherein at least the topmost member has a surface portion which is not covered by said covering member so as to be exposed to ambient air.

3. A container according to claim 1, wherein said covering member is in the form of a non-liquid absorbing sheet having a function of suppressing evaporation of the waste ink.

4. A container according to claim 1, wherein a lower member of said laminated members has a surface portion which does not contain organic solvent and which is not covered by said covering member so as to be exposed to ambient air.

5. An ink jet recording apparatus comprising a residual ink container according to any one of claims 1-4.

6. An ink jet recording apparatus comprising:

a waste ink accommodation unit having (i) elongated-plate-like laminated members for accommodating waste ink not used for recording, wherein at least a topmost member of said laminated members has a surface portion which does not contain organic solvent and which is exposed to ambient air, and (ii) an evaporation suppression member disposed above said topmost member with a gap between said evaporation suppression member and said topmost member, wherein said evaporation suppression member extends to bridge between a first ink receiving portion and a second ink receiving portion.

7. An apparatus according to claim 6, wherein said evaporation suppression member is in the form of a non-liquid absorbing sheet, and a bottommost member of said laminated members is provided with a surface not containing organic solvent and exposed to ambient air.

8. An apparatus according to claim 6, wherein a first portion of said waste ink accommodation unit having said first ink receiving portion and covered with said evaporation suppression member has a volume which is larger than a volume of a second portion having said second ink receiving portion and covered with said evaporation suppression member.

9. An apparatus according to claim 6, wherein the waste ink received by said first ink receiving portion is pigment ink.

* * * * *